US009510125B2

(12) United States Patent
Raghuvanshi et al.

(10) Patent No.: US 9,510,125 B2
(45) Date of Patent: Nov. 29, 2016

(54) PARAMETRIC WAVE FIELD CODING FOR REAL-TIME SOUND PROPAGATION FOR DYNAMIC SOURCES

(71) Applicant: Microsoft Technology Licensing, LLC, Redmond, WA (US)

(72) Inventors: Nikunj Raghuvanshi, Redmond, WA (US); John Michael Snyder, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 49 days.

(21) Appl. No.: 14/311,208

(22) Filed: Jun. 20, 2014

(65) Prior Publication Data

US 2015/0373475 A1 Dec. 24, 2015

(51) Int. Cl.

| | |
|---|---|
| ***H04S 7/00*** | (2006.01) |
| ***G10K 15/02*** | (2006.01) |
| ***G10L 19/00*** | (2013.01) |

(52) U.S. Cl.

CPC ..... *H04S 7/30* (2013.01); *G10K 15/02* (2013.01); *G10L 19/00* (2013.01); *H04S 2420/13* (2013.01)

(58) Field of Classification Search

CPC .... H04S 7/302; H04S 2420/01; H04S 7/303; H04S 7/301; H04S 7/30; H04S 2400/11; H04S 7/307

USPC ..... 381/303

See application file for complete search history.

(56) References Cited

U.S. PATENT DOCUMENTS

| | | | | |
|---|---|---|---|---|
| 7,146,296 | B1 | 12/2006 | Carlbom et al. | |
| 7,606,375 | B2 | 10/2009 | Bailey et al. | |
| 7,881,479 | B2 * | 2/2011 | Asada | G10K 15/12 381/56 |
| 8,670,850 | B2 | 3/2014 | Soulodre | |
| 2005/0058297 | A1 | 3/2005 | Jot et al. | |
| 2007/0294061 | A1 | 12/2007 | Carlbom et al. | |
| 2008/0069364 | A1 | 3/2008 | Itou et al. | |
| 2008/0137875 | A1 | 6/2008 | Zong et al. | |

(Continued)

OTHER PUBLICATIONS

Raghuvanshi, et al., "Precomputed wave simulation for Real-Time Sound Propagation of Dynamic Sources in Complex Scenes", Journal of ACM Transactions on Graphics, vol. 29, Issue 4, Jul. 2010, 11 pages.*

(Continued)

*Primary Examiner* — Mark Blouin

(74) *Attorney, Agent, or Firm* — Alin Corie; Sandy Swain; Micky Minhas

(57) ABSTRACT

The techniques discussed herein may facilitate real-time computation and playback of a propagated signal(s) perceived at a listener location in a three-dimensional environment in response to reception of a desired anechoic signal at a source location in the three-dimensional environment. The propagated audio realistically accounts for dynamic signal sources, dynamic listeners, and effects caused by the geometry and composition of the three-dimensional environment. The techniques may parameterize impulse response(s) of the environment and convolve the anechoic signal with canonical filters at run-time in a manner that respects the parameters of the parameterized impulse response(s). The techniques also provide for real-time computation and playback of a propagated audio signal perceived at a listener location in a virtual three-dimensional environment responsive to generation of source audio signals generated at multiple source locations in the virtual three-dimensional environment.

21 Claims, 18 Drawing Sheets

(56) References Cited

U.S. PATENT DOCUMENTS

| | | | | |
|---|---|---|---|---|
| 2008/0273708 | A1 | 11/2008 | Sandgren et al. | |
| 2009/0046864 | A1* | 2/2009 | Mahabub | H04S 7/30 381/17 |
| 2011/0081023 | A1* | 4/2011 | Raghuvanshi | H04S 7/30 381/17 |
| 2012/0269355 | A1 | 10/2012 | Chandak et al. | |

OTHER PUBLICATIONS

"International Search Report and Written Opinion Issued in PCT Application No. PCT/US2015/036767", Mailed Date: Sep. 14, 2015, 18 pages.
Huopaniemi, et al., "Creating Interactive Virtual Auditory Environments", In Proceedings of the IEEE on Computer Graphics and Applications, vol. 22, Issue 4, Jul. 1, 2002, pp. 49-57.
"Acoustics-Measurement of room acoustic parameters—Part 1: Performance Spaces", http://www.iso.org/iso/home/store/catalogue_detail.htm?csnumber=40979, May 2014, 2 pages.
Ajdler, et al., "The Plenacoustic Function and Its Sampling", IEEE Transactions on Signal Processing, vol. 54, Issue 10, Oct. 2006, 15 pages.
Bradley, et al., "Accuracy and reproducibility of Auditorium Acoustics Mesaures", Proceedings of British Institute of Acoustics, vol. 10, May 2014, 2 pages.
Calamia, Paul T. "Advances in Edge-Diffraction Modeling for Virtual-Acoustic Simulations" Doctoral Dissertation of Princeton University, Jun. 2009, 159 pages.
Chandak, et al., "AD Frustum: Adaptive Frustum Tracing for Interactive Sound Propagation" IEEE Transactions on Visualization and Computer Graphics, vol. 14, Issue 6, Nov. 2008, 8 pages.
Cheng, et al. "Heritage and early history of the boundary element method", Proceedings of Engineering Analysis with Boundary Elements, vol. 29, Issue 3, Mar. 2006, 35 pages.
Funkhouser, et al., "A Beam Tracing Method for Interactive Architectural Acoustics", Journal of the Acoustical Society of America, Feb. 2004, 18 pages.
Funkhouser, et al., "Realtime Acoustic Modeling for Distributed Virtual Environments", Proceedings of the 26th Annual Conference on Computer Graphics and Interactive Techniques, Jul. 1999, 10 pages.
Gade, Anders, "Acoustics in Halls for Speech and Music", Springer Handbook of Acoustics, May 2014, 8 pages.
Gumerov, et al., "Fast multipole methods on graphic processors", Journal of Computational Physics, vol. 227, Issue 18, Sep. 2008, 4 pages.
Harris, Fredric J., "On the use of windows for harmonic Analysis with the Discrete Fourier Transform", Proceedings of the IEEE, vol. 66, Issue 1, Jan. 1978, 33 pages.
Hodgson, et al., "Experimental evaluation of radiosity for room sound-field predicton", Journal of the Acoustical Society of America, Aug. 2006, 12 pages.
"Interactive 3D Audio Rendering Guidelines", Proceedings of 3D Working Group of the Interactive Audio Special Interest Group, Sep. 1999, 29 pages.
Kolarik, et al., "Perceiving auditory distance using level and direct-to-reverberant ratio cues", Journal of the Acoustical Society of America, vol. 130, Issue 4, Oct. 2011, 4 pages.
Krokstad, Asbjorn, "The Hundred Years Cycle in Room Acoustic Research and Design", Proceedings of Reflections on Sound, Jun. 2008, 30 pages.
Kuttruff, Heinrich, "Room Acoustics, Fourth Edition", Aug. 2000, 1 page.
Li, et al., "Spatial Sound Rendering Using Measured Room Impulse Responses" IEEE International Symposium on Signal Processing and Information Technology, Aug. 2006, 5 pages.
Mehra, et al., "An efficient GPU-based Time Domain Solver for the Acoustic Wave Equation", Proceedings of Applied Acoustics, vol. 73, Issue 2, Feb. 2012, 13 pages.
Mehra, et al., "Wave-Based Sound Propagation in Large Open Scenes Using an Equivalent Source Formulation", Journal of ACM Transactions on Graphics, vol. 32, Issue 2, Apr. 2013, 13 pages.
Mehrota, et al., "Interpolation of Combined Head and Room Impulse Response for Audio Spatialization" Proceeding of IEEE 13th International Workshop on Multimedia Signal Processing, Ocrober 2011, 6 pages.
Pierce, Allan D., "Acoustics: An Introduction to Its Physical Principles and Applications" Acoustical Society of America, Jun. 1989, 4 pages.
Raghuvanshi, et al., "Efficient and Accurate Sound Propagation Using Adaptive Rectangular Decomposition" IEEE Transactions on Visualization and Computer Graphics, vol. 15, Issue 99, Feb. 2009, 13 pages.
Raghuvanshi, Nikunj, "Interactive Physically-based Sound Simulation", UMI Dissertation, Sep. 2011, 187 pages.
Rindel, et al., "The Use of Colors, Animations, and Auralizations in Room Acoustics" Internoise, Sep. 2013, 9 pages.
Sabine, Hale J., "Room acoustics", Transactions of the IRE Professional Group on Audio, vol. 1, Issue 4, Jul. 1953, 9 pages.
Sakamoto, et al., "Calculation of impulse responses and acoustic parameters in a hall by the finite-difference time-domain method", Proceedings of Acoustical Science and Technology, vol. 29, Issue 4, Feb. 2008, 10 pages.
Savioja, Lauri, "Real-Time 3D Finite-Difference Time-Domain Simulation of Low- and Mid-Frequency Room Acoustics", Proceedingsof the 13th International Conference on Digital Audio Effects, Sep. 2010, 8 pages.
Savioja, et al., "Simulation of Room Acoustics with a 3-D Finite Difference Mesh", Proceedings of the International Computer Music Conference, Sep. 1994, 4 pages.
Stettner, et al., "Computer Graphics Visualization for Acoustic Simulation", Proceedings of the 16th Annual Conference on Computer Graphics and interactive techniques, vol. 23, No. 3, Jul. 1989, 11 pages.
Svensson, et al., "Frequency-Domain Edge Diffraction for finite and infinite edges", Proceedings of Acta acstica united with acustica, vol. 95, No. 3, May 2014, 2 pages.
Svensson, et al., "The use of Ambisonics in describing room impulse responses", Proceedings of the International Congress on Acoustics, Apr. 2004, 4 pages.
Takala, et al., "Sound Rendering", Proceedings of Siggraph Computer Graphics, Jul. 1992, 11 pages.
Taylor, et al., "RESound:Interactive Sound Rendering for Dynamic Virtual Environments", Proceedings of the 17th ACM International Conference on Multimedia, Oct. 2009, 10 pages.
Thompson, Lonny L., "A review of finite-element methods for time-harmonic acoustics", Journal of Acoustical Society of America, vol. 119, Issue 3, Mar. 2006, 16 pages.
Valimaki, et al., "Fifty Years of Artificial Reverberation", IEEE Transactions on Audio, Speech, and Language Processing, vol. 20, Issue 5, Jul. 2012, 28 pages.
van der Vorm, "Transform Coding of Audio Impulse Responses", Master's Thesis of Delft University of Technology, Aug. 2003, 109 pages.
Yeh, et al., "Wave-ray Coupling for Interactive Sound Propagation in Large Complex Scenes", Journal of ACM Transactions on Graphics, vol. 32, Issue 6, Nov. 2013, 10 pages.
Astheimer, Peter, "What You See Is What You Hear—Acoustics Applied in Virtual Worlds", In Proceedings of IEEE Symposium on Research Frontiers in Virtual Reality, Oct. 25, 1993, pp. 100-107.
Final Office Action Issued in U.S. Appl. No. 12/573,157, Mailed Date: Feb. 17, 2015, 18 Pages.
Final Office Action Issued in U.S. Appl. No. 12/573,157, Mailed Date: Jul. 5, 2013, 18 Pages.
Funkhouser, et al., "Survey of Methods for Modeling Sound Propagation in Interactive Virtual Environment Systems", Retrieved From <<http://www-sop.inria.fr/reves/Nicolas.Tsingos/publis/presence03.pdf>>, 2003, 53 Pages.

(56) References Cited

OTHER PUBLICATIONS

Lauterbach, et al., "Interactive Sound Rendering In Complex and Dynamic Scenes Using Frustum Tracing", In Proceedings of IEEE Transactions on Visualization and Computer Graphics ( vol. 13, Issue: 6 ), Nov. 2007, pp. 1672-1679.

Lentz, et al., "Virtual Reality System with Integrated Sound Field Simulation and Reproduction", In EURASIP Journal on Applied Signal Processing, Issue 1, Jan. 1, 2007, 22 Pages.

Non Final Office Action Issued in U.S. Appl. No. 12/573,157, Mailed Date: Nov. 28, 2012, 12 Pages.

Non Final Office Action Issued in U.S. Appl. No. 12/573,157, Mailed Date: Apr. 23, 2014, 19 Pages.

Non Final Office Action Issued in U.S. Appl. No. 12/573,157, Mailed Date: Aug. 20, 2015, 18 Pages.

Wand, et al., "A Real-Time Sound Rendering Algorithm for Complex Scenes", Retrieved at <<https://web.archive.org/web/20090605124135/http://www.mpi-inf.mpg.de/~mwand/papers/tr03.pdf>>, Jul. 2003, 13 Pages.

* cited by examiner

ENERGY DECAY PROFILES

CANONICAL IR ($T_{ER}$ = 1.0), TIME DOMAIN

CANONICAL IR ($T_{ER}$ = 1.0), FREQUENCY DOMAIN

| Scene | # polys (million) | dimensions (m) L | W | H | # boxes | # probes | sim. cyl. $r, h$ (m) | $\Delta_{x_s}$ $v, h$ (m) | $\Delta_{x_l}$ (m) | spatial compression ratios $L_{DS}$ | $L_{ER}$ | $T_{ER}$ | $T_{LR}$ | net | raw (TB) | encoded (MB) | bake (h) |
|---|---|---|---|---|---|---|---|---|---|---|---|---|---|---|---|---|---|
| Citadel | 0.4 | 224 | 187 | 53 | 27 | 1622 | 45, 20 | 3, 1.6 | 2 | 4.2 | 4.8 | 4.0 | 7.5 | 4.8 | 56 | 44.1 | 12 |
| Deck | 1.9 | 135 | 143 | 37 | 2 | 1263 | 45, 20 | 3, 1.6 | 2 | 6.9 | 8.2 | 6.3 | 12.6 | 7.9 | 44 | 20.8 | 13 |
| Sanctuary | 2.4 | 181 | 151 | 34 | 5 | 1613 | 45, 20 | 3, 1.6 | 2 | 4.6 | 5.1 | 4.2 | 7.8 | 5.1 | 56 | 41.1 | 15 |
| Necropolis | 2.1 | 358 | 169 | 31 | 42 | 2405 | 45, 15 | 4, 1.6 | 2 | 3.7 | 4.2 | 4.1 | 6.1 | 4.4 | 66 | 53.7 | 20 |
| Foliage | 2.6 | 144 | 149 | 15 | 3 | 662 | 35, 11 | 2, 1.8 | 1 | 6.0 | 8.0 | 8.3 | 11.1 | 8.0 | 9 | 33.0 | 4 |

FIG. 17

PARAMETRIC WAVE FIELD CODING FOR REAL-TIME SOUND PROPAGATION FOR DYNAMIC SOURCES

BACKGROUND

Video games and other virtual simulations have become increasingly realistic due to increased processing speeds and larger, more affordable storage capacities in computing devices. These advancements have allowed virtual environment designers to incorporate some limited effects of real world physics in video games and other virtual simulations. For this reason, many video games now incorporate physics engines that simulate real world physics using mathematical models. However, realistic audio has been notoriously difficult to simulate, however. Attempts to use wave equations that model sound propagated in a virtual environment and perceived at a listener location have been unfeasible to implement due to real-time processing and storage constraints. Because of this many game studios hand-code video game audio in order to imitate the effect virtual environments have on sound propagated within those environments.

In particular, the space required to store characteristics (i.e., the impulse responses) of an environment increases super-linearly as environment volume increases and the impulse responses are generally chaotic, making them less suitable for compression. Furthermore, calculating propagated sound at a listener location in an environment using physics models requires convolving a source audio signal with the impulse response of the environment between the source location and the listener location. Convolution has a high processing cost. Typical video game console, desktop computer, and mobile device hardware affords only enough processing power to calculate the propagated audio for up to ten sources at any one time due to the constraints put on the amount of total processing allocated to audio processing for a video game. In many video games, there are up to hundreds of sources of audio signals in the video game so there is currently no way to conduct the number of convolutions required to model the propagated audio signal. Furthermore, when an environment contains sources that are moving quickly through the environment, the impulse response to be convolved with the audio signal changes rapidly, causing reverberation in the scene to be clipped, which a user may perceive as system lag.

SUMMARY

The techniques discussed herein facilitate real-time computation and playback of propagated audio signal(s) perceived at a listener location in a three-dimensional environment in response to reception of a desired anechoic audio signal at a source location in the virtual three-dimensional environment. The propagated audio realistically accounts for dynamic audio signal sources, dynamic listeners, and acoustical effects caused by the geometry and composition of the three-dimensional virtual environment. The techniques also provide for real-time computation and playback of a propagated audio signal perceived at a listener location in a virtual three-dimensional environment responsive to generation of source audio signal(s) generated at source location(s) in the virtual three-dimensional environment.

The techniques discussed herein may convert impulse response fields modeling the acoustical characteristics of a virtual three-dimensional environment to fields corresponding to a number of parameters. Furthermore, the techniques may apply canonical filters conforming to parameters decoded from the fields to an audio signal.

This Summary is provided to introduce a selection of concepts in a simplified form that are further described below in the Detailed Description. This Summary is intended to be used as an aid in determining the scope of the claimed subject matter. The term "techniques," for instance, may refer to system(s), method(s), computer-readable media/instructions, module(s), algorithms, hardware logic (e.g., Field-programmable Gate Arrays (FPGAs), Application-Specific Integrated Circuits (ASICs), Application-Specific Standard Products (ASSPs), System-on-a-chip systems (SOCs), Complex Programmable Logic Devices (CPLDs)), and/or technique(s) as permitted by the context described above and throughout the document.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

FIG. 17 is a table depicting experimental results of one simulation and encoding example conducted on five virtual environments.

DETAILED DESCRIPTION

Overview

This disclosure is directed to techniques to calculate the propagation of a signal from a source(s) in an environment to a receiver.

Examples described herein provide techniques to facilitate real-time computation and reproduction of a propagated audio signal perceived at a listener location in a virtual three-dimensional environment in response to an anechoic (i.e., unpropagated) audio signal at a source location in the three-dimensional environment. In contrast to previous approaches, this technique does not store the impulse response field of a virtual environment. Rather, a number of perceptual parameters may be extracted from the impulse responses' energy decays and these perceptual parameters may be encoded as parameter fields. In some examples, instead of convolving an impulse response and source audio signal once per source, the techniques provide for splitting each source signal into copies scaled according to perceptual parameters of the impulse response corresponding to the source/listener location pair and accumulating a sum of split source signals over the sources to be convolved with a number of canonical filters, the canonical filters being fixed filters. Furthermore, in some examples, this technique does not convolve using the impulse response or filters generated at run-time for each source. Rather, in at least one example, this technique uses filters that have characteristics fixed before run-time and convolves these fixed filters with a weighted sum of split source signal(s) to be propagated.

The techniques and systems described herein may be implemented in a number of ways. Example implementations are provided below with reference to the following figures. The implementations, examples, and illustrations described herein may be combined.

Illustrative Environment

Figure 1:
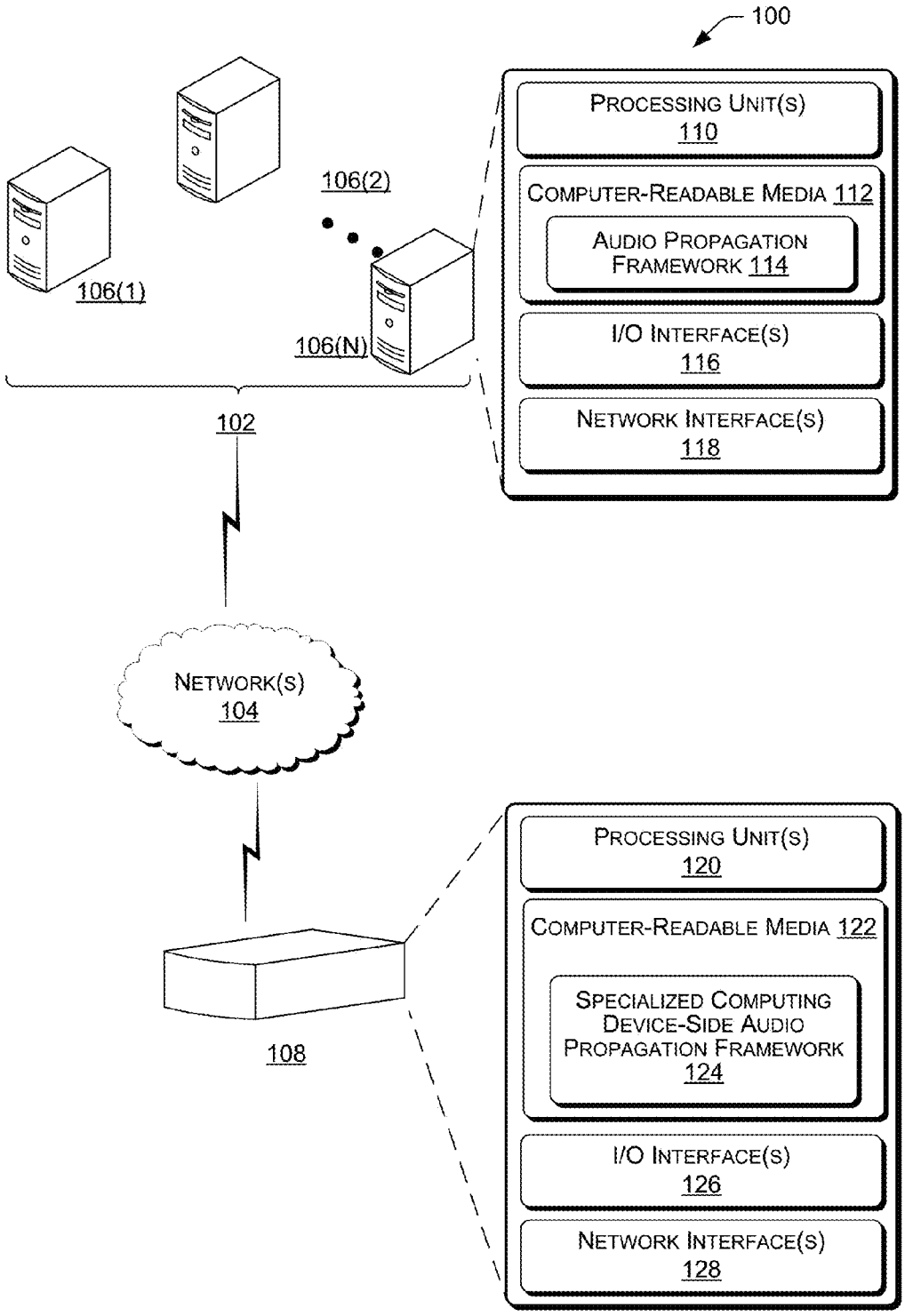
FIG. 1 is a block diagram depicting an example environment in which examples of an audio propagation framework may operate.

FIG. 1 is a block diagram depicting an example environment 100 in which examples described herein may operate. In some examples, the various devices and/or components of environment 100 include distributed computing resources 102 that may communicate with one another and with external devices via one or more networks 104.

For example, network(s) 104 may include public networks such as the Internet, private networks such as an institutional and/or personal intranet, or some combination of private and public networks. Network(s) 104 may also include any type of wired and/or wireless network, including but not limited to local area networks (LANs), wide area networks (WANs), satellite networks, cable networks, Wi-Fi networks, WiMax networks, mobile communications networks (e.g., 3G, 4G, and so forth) or any combination thereof. Network(s) 104 may utilize communications protocols, including packet-based and/or datagram-based protocols such as internet protocol (IP), transmission control protocol (TCP), user datagram protocol (UDP), or other types of protocols. Moreover, network(s) 104 may also include a number of devices that facilitate network communications and/or form a hardware basis for the networks, such as switches, routers, gateways, access points, firewalls, base stations, repeaters, backbone devices, and the like.

In some examples, network(s) 104 may further include devices that enable connection to a wireless network, such as a wireless access point (WAP). Examples support connectivity through WAPs that send and receive data over various electromagnetic frequencies (e.g., radio frequencies), including WAPs that support Institute of Electrical and Electronics Engineers (IEEE) 1302.11 standards (e.g., 1302.11g, 1302.11n, and so forth), and other standards.

In various examples, distributed computing resource(s) 102 includes computing devices such as devices 106(1)-106 (N). Examples support scenarios where device(s) 106 may include one or more computing devices that operate in a cluster or other grouped configuration to share resources, balance load, increase performance, provide fail-over support or redundancy, or for other purposes. Although illustrated as desktop computers, device(s) 106 may include a diverse variety of device types and are not limited to any particular type of device. Device(s) 106 may include specialized computing device(s) 108.

For example, device(s) 106 may include any type of computing device having one or more processing unit(s) 110 operably connected to computer-readable media 112, I/O interfaces(s) 116, and network interface(s) 118. Computer-readable media 112 may have an audio propagation framework 114 stored thereon. Also, for example, specialized computing device(s) 108 may include any type of computing device having one or more processing unit(s) 120 operably connected to computer-readable media 112, I/O interface(s) 126, and network interface(s) 128. Computer-readable media 112 may have a specialized computing device-side audio propagation framework 124 stored thereon.

Figure 2:
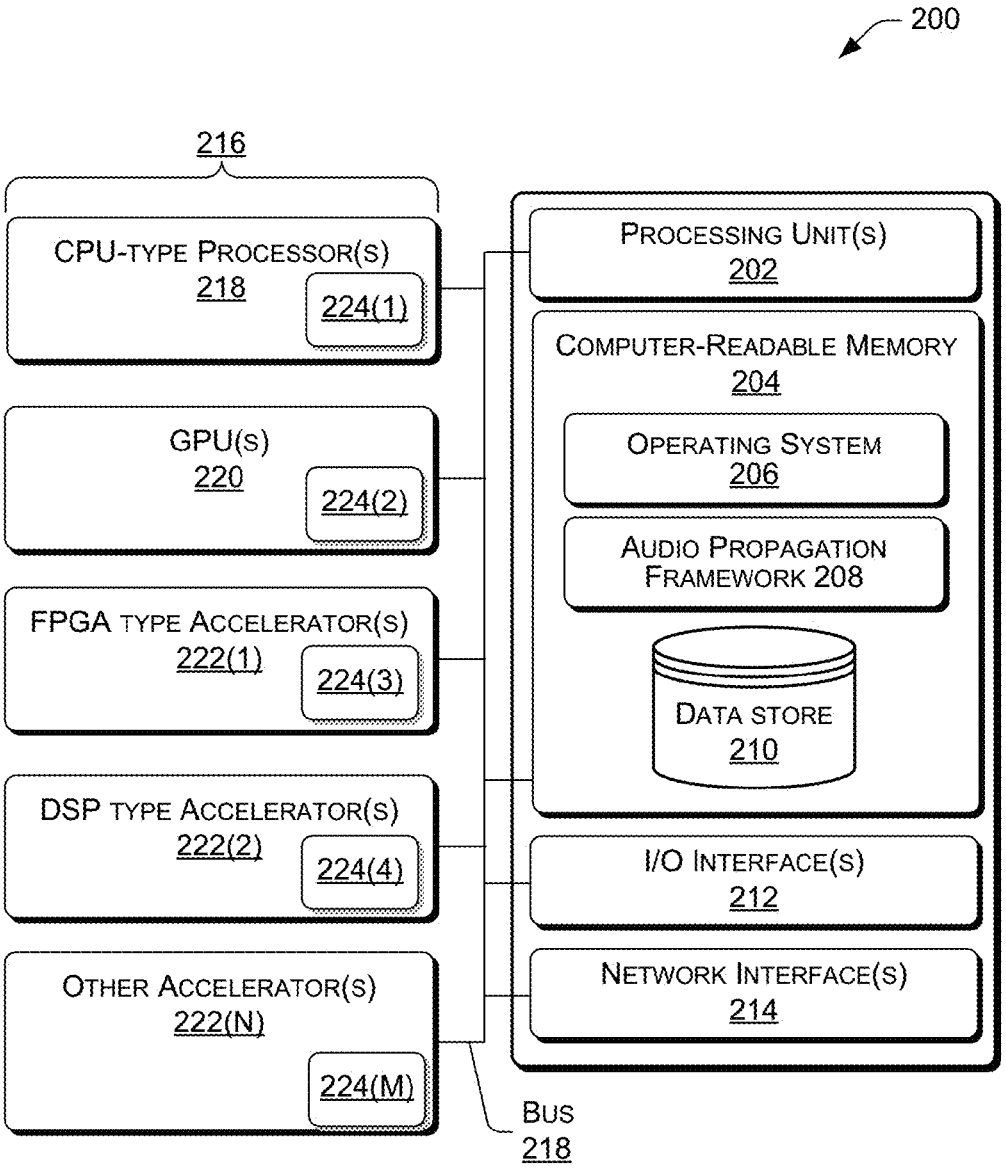
FIG. 2 is a block diagram depicting an example device that may compute audio propagation within an environment, according to various examples.

FIG. 2 depicts an illustrative device 200, which may represent device(s) 106 or 108. Illustrative device 200 may include any type of computing device having one or more processing unit(s) 202, such as processing unit(s) 110 or 120, operably connected to computer-readable media 204, such as computer-readable media 112 or 122. The connection may be via a bus 218, which in some instances may include one or more of a system bus, a data bus, an address bus, a PCI bus, a Mini-PCI bus, and any variety of local, peripheral, and/or independent buses, or via another operable connection. Processing unit(s) 202 may represent, for example, a CPU incorporated in device 200. The processing unit(s) 202 may similarly be operably connected to computer-readable media 204.

The computer-readable media 204 may include, at least, two types of computer-readable media, namely computer storage media and communication media. Computer storage media may include volatile and non-volatile, non-transitory machine-readable, removable, and non-removable media implemented in any method or technology for storage of information (in compressed or uncompressed form), such as computer (or other electronic device) readable instructions, data structures, program modules, or other data to perform processes or methods described herein. The computer-readable media 112 and the computer-readable media 122 are examples of computer storage media. Computer storage media includes, but is not limited to hard drives, floppy diskettes, optical disks, CD-ROMs, DVDs, read-only memories (ROMs), random access memories (RAMs), EPROMs, EEPROMs, flash memory, magnetic or optical cards, solid-state memory devices, or other types of media/machine-readable medium suitable for storing electronic instructions.

In contrast, communication media may embody computer-readable instructions, data structures, program modules, or other data in a modulated data signal, such as a carrier wave, or other transmission mechanism. As defined herein, computer storage media does not include communication media.

Device 200 may include, but is not limited to, desktop computers, server computers, web-server computers, personal computers, mobile computers, laptop computers, tablet computers, wearable computers, implanted computing devices, telecommunication devices, automotive computers, network enabled televisions, thin clients, terminals, personal data assistants (PDAs), game consoles, gaming devices, work stations, media players, personal video recorders (PVRs), set-top boxes, cameras, integrated components for inclusion in a computing device, appliances, or any other sort of computing device such as one or more separate processor device(s) 216, such as CPU-type processors (e.g., micro-processors) 218, GPUs 220, or accelerator device(s) 222.

In some examples, as shown regarding device 200, computer-readable media 204 may store instructions executable by the processing unit(s) 202, which may represent a CPU incorporated in device 200. Computer-readable media 204 may also store instructions executable by an external CPU-type processor 218, executable by a GPU 220, and/or executable by an accelerator 222, such as an FPGA type accelerator 222(1), a DSP type accelerator 222(2), or any internal or external accelerator 222(N).

Executable instructions stored on computer-readable media 202 may include, for example, an operating system 206, an audio propagation framework 208, and other modules, programs, or applications that may be loadable and executable by processing units(s) 202, and/or 216. Alternatively, or in addition, the functionally described herein may be performed, at least in part, by one or more hardware logic components such as accelerators 222. For example, and without limitation, illustrative types of hardware logic components that may be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc. For example, accelerator 222 (N) may represent a hybrid device, such as one from ZYLEX or ALTERA that includes a CPU core embedded in an FPGA fabric.

In the illustrated example, computer-readable media 204 also includes a data store 210. In some examples, data store 210 includes data storage such as a database, data warehouse, or other type of structured or unstructured data storage. In some examples, data store 210 includes a relational database with one or more tables, indices, stored procedures, and so forth to enable data access. Data store 210 may store data for the operations of processes, applications, components, and/or modules stored in computer-readable media 204 and/or executed by processor(s) 202 and/or 218, and/or accelerator(s) 212. For example, data store 210 may store version data, iteration data, clock data, and other state data stored and accessible by the audio propagation framework 208. Alternately, some or all of the above-referenced data may be stored on separate memories 224 such as a memory 224(1) on board a CPU type processor 218 (e.g., microprocessor(s)), memory 224(2) on board a GPU 220, memory 224(3) on board an FPGA type accelerator 222(1), memory 224(4) on board a DSP type accelerator 222(2), and/or memory 224(M) on board another accelerator 222(N).

Device 200 may further include one or more input/output (I/O) interface(s) 212, such as I/O interface(s) 116 or 126, to allow device 200 to communicate with input/output devices such as user input devices including peripheral input devices (e.g., a keyboard, a mouse, a pen, a game controller, a voice input device, a touch input device, a gestural input device, and the like) and/or output devices including peripheral output devices (e.g., a display, a printer, audio speakers, a haptic output, and the like). Device 200 may also include one or more network interface(s) 214, such as network interface(s) 118 or 128, to enable communications between computing device 200 and other networked devices such as other device 200 over network(s) 214. Such network interface(s) 214 may include one or more network interface controllers (NICs) or other types of transceiver devices to send and receive communications over a network.

Illustrative Audio Propagation Framework

Figure 3:
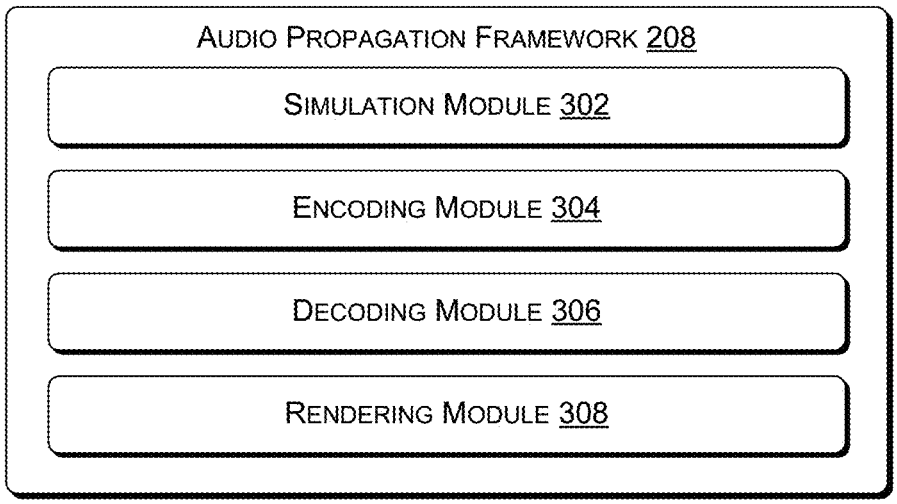
FIG. 3 is a block diagram depicting an example audio propagation framework to compute audio propagation within an environment, according to some examples.

FIG. 3 is a block diagram of module of an illustrative audio propagation framework 208 that may be distributively or singularly stored on one or more devices 200. Some or all of the modules may be available to, accessible from, or stored on a remote device, such as a cloud services system distributed computing resources 102, or device(s) 106. In at least one example, an audio propagation framework 208 comprises modules 302, 304, 306, and 308 as described herein that provide real-time audio signal propagation for dynamic sources in a virtual environment using parameteric coding. In some examples, any number of modules could be employed and techniques described herein as employed by one module may be employed by any other(s) module in various examples.

In at least one example, simulation module 302 models the acoustical properties of a virtual environment so that sounds emitted from one location in the virtual environment may be reproduced at another location in the virtual environment in a manner that corresponds with human perception of sound. The simulation module 302 may account for the effect an environment has on sound due to its geometry and medium (e.g., accounting for occlusion, obstruction, exclusion due to geometry and the material of the geometry, e.g., wood, metal, air, water). For example, the virtual environment may be a concert hall and an audio signal source may be a virtual violinist standing on stage.

In an impulse response simulation example, a computing resource simulates responses of a virtual environment to pulses emitted from probe source locations defined throughout the virtual environment. Pulses emitted from one location will be perceived differently at different listener locations. The manner in which the pulse may be perceived at different locations in the virtual environment may be called an impulse response. Impulse responses vary as a function of time, pulse source location (also termed probe source here), and listener location. In some examples, the simulation module 302 may find the transfer function or step response of the environment. Any method that characterizes how an environment interacts with sound may be sufficient if that characterization may be applied to an arbitrary input signal to achieve the correct output at another point in the environment. In various examples, the simulation module 302 could be configured to conduct A-weighting and/or ABX testing and/or account for localization (using segmentation, integration, and segregation, or another approach), precedence effect, the McGurk effect, the Franssen effect, or precedence effect, among others.

In at least one example, the simulation module 302 simulates a pressure field (or equivalently a wave field; the term wave field simply describes the typical generalization of the manner in which sound propagates—time-varying compression (in the case of propagation through gases, plasma, and liquids as longitudinal waves) and shear stress (in the case of propagation in solids as transverse and longitudinal waves)). In some examples, the simulation may be limited to longitudinal wave models, ignoring sound propagation in solids in the environment. The simulation module 302 may still account for the media of solids by using reflection coefficients. In some examples, liquids may be treated as solids for ease of understanding. In various examples, the simulation module may simulate the effect of sound in solids or, alternatively, in the environment media.

For example, the simulation module may simulate a seven dimensional wave (or pressure) field, denoted $P(x_s, x_l, t)$ (the dimensionality of the pressure field could be higher if more acoustical properties are accounted for but seven dimensions is sufficient for environment auralization). An example pressure field, such as $P(x_s, x_l, t)$, may be seven dimensional because it may vary as a function of signal source location in three-dimensional space, $x_s$; listener location in three-dimensional space, $x_l$; and time, t. The amplitudes of the pressure field in time at specific signal source and listener locations compose the impulse response of the virtual environment for that specific source/listener pair.

After the pressure field is calculated, an encoding module 304 may encode the pressure field. Encoding may be conducted for a variety of reasons and therefore may take a variety of forms. Encoding may be used to, for example, accelerate processing, decrease storage requirements, secure data, abstract data, simplify complex models for analysis, translate data, map data, more easily recognize data, make information more memorable for humans, etc. In order to accomplish one or some of these goals, the encoding module 304 may employ different methods. For example, if it was desirable to accelerate processing of data and decrease storage requirements, encoding module 304 may employ quantization and compression of data.

In at least one example, to reduce computation and storage requirements, the encoding conducted by the encoding module 304 comprises parameterizing the seven-dimensional pressure field. The seven-dimensional pressure field discussed above comprises impulse responses of different probe source/listener pairs in time in some examples. The encoding module 304 may extract parameters from these impulse responses composing the pressure field. The extracted parameters may abstract characteristics of the impulse response so that explicit details of the impulse response need not be computed or stored. Although impulse responses may be complex, impulse responses may be characterized as having three phases: direct sound, early reflections, and late reverberation. Furthermore, the human ear is only able to detect certain characteristics of propagated sound. Some of these characteristics include directionality, pitch, the magnitude of the propagated sound that first reaches the ear ("direct sound loudness"), the magnitude of the reflections of the propagated sound from the environment geometry ("early reflection loudness"), the decay time of early reflections ("early decay time"—how quickly early reflections fade), late reverberation loudness, and late reverberation time (how quickly late reverberation fade). Therefore, in some examples, a subset of the perceived characteristics of the impulse responses, such as the direct sound loudness, early reflection loudness, early decay time, and late reverberation time, may be parameterized by the encoding module 304. In at least one example, the parameters may not vary in time (e.g., they may be scalar values where the time implicit). In some examples, time may be preserved so that the parameters vary in time. In various examples, the encoding module 304 may smooth (e.g., spatially smooth), sample (e.g., spatially sample), quantize, compress (e.g., spatially compress), secure, or store the pressure field, among other techniques.

The process up until this point may be described as "pre-computation" because, in some examples, modules may simulate and encode a parameter field before other modules calculate propagation of an arbitrary audio signal from a specific source location in a virtual environment to a specific listener. In some examples pursuant to the pre-computation implementation, the encoded parameter fields may be stored for retrieval by a decoding module 306. The decoding module 306 may not reside on the same device as the encoding module 304. For example, in a video game application the encoded parameter fields may be stored as a part of video game software and decoded at a video game console or mobile device. As another example, in an audio engineering application the encoded parameter fields for a concert hall model may be calculated, stored, and decoded on the same device.

A decoding module 306 may decode the encoded parameter fields to obtain parameters of describing an impulse response for a particular audio signal source location and a particular listener location. In at least one example, decoding may be conducted at run-time, once a particular set of signal source location(s) and listener location is known. The decoding module 306 may decode a portion of the encoded parameter fields (for a particular location), certain ones of the encoded parameter fields (for a particular parameter), or the decoding module 306 may decode the parameter fields. The decoding module 306 may spatially interpolate parameters for a source/listener pair when one or both of the source and listener lie between probe source locations.

In an example that utilizes encoding and decoding, once decoded parameters may be received, a rendering module 308 uses the decoded parameters to modify the audio signal to be propagated from the source. In at least one example, the rendering module makes use of acoustical reciprocity by inverting the source and the listener positions, so as to only need to decode the encoded parameter fields for the listener location, rather than the source locations. Inverting the source and listener positions before decoding reduces the number of spatial decompression operations conducted at runtime. Using this technique, the number of decompress operations scale with the number of listeners rather than with the number of sources.

In accordance with one example that uses impulse responses to characterize the virtual environment's acoustical characteristics and in order to properly propagate the arbitrary audio signal, the rendering module 308 creates filters with characteristics that conform to the decoded parameters, so that the filters have characteristics that correlate to characteristics of the simulated impulse response of the virtual environment. The rendering module 308 may realize application of these created filters without computing the created filters explicitly.

Rather, in at least one example, the rendering module 308 may scale signals with weights calculated to conform with decoded parameters and convolve the scaled signals with canonical filters (CFs). In one example, the computing resource calculates the weights such that if the weights were applied to the CFs, the CFs would have characteristics conforming to the decoded parameters. Note that applying the weights to the CFs would violate the definition of CFs as fixed filters; scaling by the weights would modify the CFs from an original design.

In at least one example, the rendering module 308 may utilize associativity of scalar multiplication and scale signal(s) input into the fixed filters with the weights instead of scaling the fixed filters. In this example, the CFs may be applied to a sum of weighted signals once to achieve the propagated audio at a listener location. This example reduces calculation time of propagated audio at a listener location since the number of convolutions calculated is at most equal to the number of fixed filters as opposed to other methods (e.g., scaling the filters rather than the signals) where the number of convolutions calculated increases multiplicatively per source. In other words, the number of filters applied stays fixed as the number of signal sources increases.

In some examples where parameterization is not used and the impulse responses composing the pressure field may be stored in in a more robust form or in their entirety, the impulses themselves may be applied directly to the arbitrary audio signal to be propagated at a listener by source(s). When the simulation module 302 simulates and stores information that may be applied as a filter effect, those effects may be added to the created filters or impulse response, depending on the implementation.

In some examples, CFs may be any number of fixed filters. In at least one example, the CFs may be formed before run-time and may not be generated after run-time. In some examples, one or more of the CFs could be generated at run time and maintained for the duration of the process. The CFs may also be pre-transformed (e.g., after being generated they may be transformed into the frequency domain and maintained in the frequency domain).

In some examples, an architect could compute acoustics via simulation on a proposed concert hall design CAD model and encode a resultant simulation field using the techniques described herein for transmission over a network. In some examples, an acoustical consultant may receive an encoded simulation field over a network and may decode and visualize, using the techniques described herein, the perceptual parameter fields in order to ascertain potential defects without auralization.

Illustrative Specialized Computing Device

Figure 4:
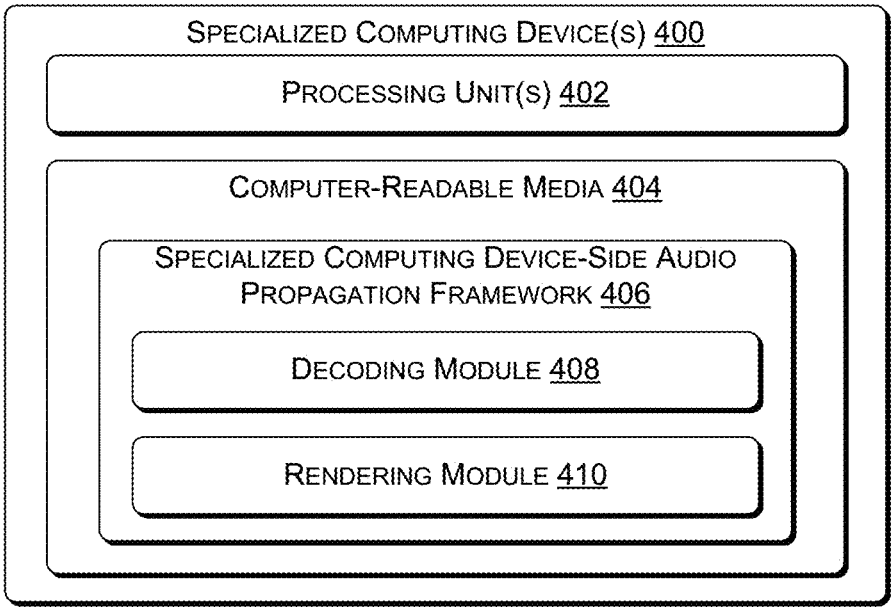
FIG. 4 is a block diagram depicting an example specialized computing device that may compute audio propagation within an environment, according to some examples.

FIG. 4 is a block diagram of illustrative specialized computing device(s) 400, such as specialized computing device(s) 108, having illustrative modules to decode and render data relating to propagation of an audio signal in a virtual three-dimensional environment.

The specialized computing device(s) 400 may include one or more processing unit(s) 402, which may represent processing unit(s) 120, and computer-readable media 404, which may represent computer-readable media 122. The computer-readable media 404 may store various modules, applications, programs, and/or data. In some examples, the computer-readable media 404 may store instructions that, when executed by the one or more processors 402, cause the one or more processors to perform the operations described herein for the illustrative specialized computing device(s) 400. The computer-readable media 402 may store a specialized computing device-side audio propagation framework 406, which may represent specialized computing device-side audio propagation framework 124, including a decoding module 408, which may represent decoding module 306, and a rendering module 410, which may represent a rendering module 308. In some examples, specialized computing device-side audio propagation framework 406 may also include a simulation module, such as 302, and/or an encoding module, such as 304.

In some examples, the audio propagation framework stored on a specialized computing device(s) 400 may differ from that stored on device(s) 200 and/or 106. Although specialized computing device(s) 400 may be communicatively coupled to zero or more specialized computing device(s) 400 or device(s) 200 and/or 106, in some instances resource configuration of the specialized computing device(s) 400 may limit the ability of the specialized computing device(s) 400 to conduct the techniques described herein. For example, resources of specialized computing device(s) 400 may have a lesser configuration relative to resources of device(s) 106. Resources may include speed of processing unit(s), availability or lack of distributed computation abilities, whether or not processing unit(s) 402 are configured to conduct parallel computations, availability or lack of I/O interfaces to facilitate user interaction, etc.

In at least one example system, device(s) 200 may perform pre-computing techniques such as simulating a pressure field by simulation module 302 and encoding the pressure field by encoding module 304 and the specialized computing device(s) 400 may conduct the techniques of decoding by decoding module 306 and rendering by rendering module 308. For example, in an implementation where the techniques described herein are applied to a video game, specialized computing device(s) 400 may represent a relatively low-resource device such as a video game console, a tablet computer, a smart phone, etc. In this example, device(s) 200 may pre-compute the parameterized impulse responses of a virtual three-dimensional video game environment and store the parameterized impulse responses so that specialized computing device(s) 400 running the video game may access the stored parameterized impulse responses, decode the parameterized impulse responses to obtain decoded parameters, and render propagated audio signals according to the decoded parameters. In various examples, the specialized computing device(s) 400 may store and run the simulation module 302 and encoding module 304.

In some examples, more or less of the modules 302, 304, 306, and 308 contained within the audio propagation framework 208 may be stored on the device(s) 200 and more or less of the modules 302, 304, 408, and 410 may be stored on the specialized computing device(s) 400 as part of a specialized computing device-side audio propagation framework 406.

Illustrative Operations

FIGS. 5, 6, 8, 12, and 13 are diagrams of illustrative processes of computing an audio signal propagation using parameterized impulse responses and canonical filters. The processes are illustrated as a collection of blocks in logical flow graphs, which represent a sequence of operations that may be implemented in hardware, software, or a combination thereof. In the context of software, the blocks represent computer-executable instructions stored on one or more computer-readable storage media that, when executed by one or more processors, perform the recited operations. Computer-executable instructions may include routines, programs, objects, components, data structures, and the like that perform particular functions or implement particular abstract data types. The order in which the operations are described is not intended to be construed as a limitation, and any number of the described blocks may be combined in any order and/or in parallel to implement the illustrated process. One or more of the processes described herein may occur independently or in relation in any order, whether in series or parallel. FIGS. 7, 9-11, 17, and 14-18 are example results from aspects of the processes described herein.

Figure 5:
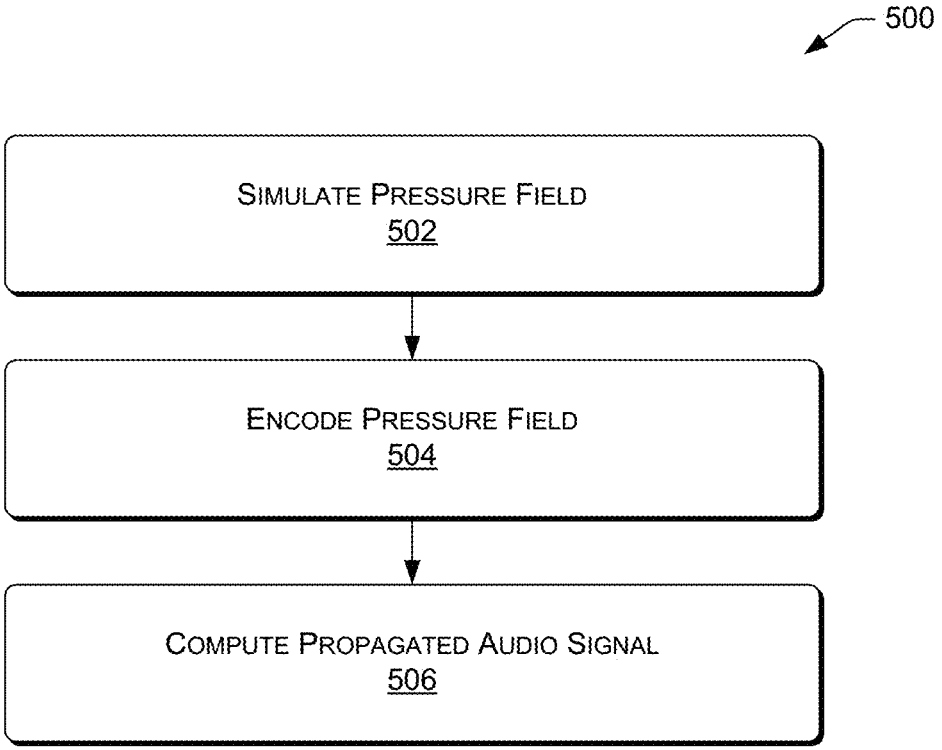
FIG. 5 is a flow diagram illustrating an example process to simulate a pressure field in an environment, encode the pressure field, and compute the propagated audio signal at run-time.

FIG. 5 is a flow diagram of an illustrative process 500 to compute a propagated audio signal at run-time.

The process 500 is described with reference to the illustrative environment 100, and may be performed by device 200 or 400 any other device or combination thereof. Of course, the process 500 (and other processes described herein) may be performed in other environments and/or by other devices. These various environment and device examples are described as "a computing resource," which may include "a computing device." In at least one example, process 500 is a fast auralization. The time to conduct the auralization may vary as a function of computing resource chosen to conduct the auralization, amount of the process conducted, signal size, number of sources, and number or listeners, among other factors, but the time to conduct the auralization is "fast" because of the vast reduction of computing time required over other methods of auralization that accomplish the same effects.

In at least one example, at 502, a computing resource, such as device 200, receives environment geometry as an input and may also receive a variety of constraints such as sampling controls (e.g., cell size, voxel size, maximum simulation frequency, probe source spacing and location selection parameters, and simulation run time). The computing resource may receive these inputs through any number I/O, capture, or communication devices (e.g., through keyboard and mouse input from a user, streaming read from a hard disk, sonar, video, etc.). For example, in a video game context, the computing resource may obtain geometry of the video game from a data store, a game designer, etc. In some example contexts, a video of an environment may be used to provide a three-dimensional environment to the computing resource. At 502, a simulation module, such as 302, may define probe source locations within the environment geometry of a virtual environment and outputs a (at least) seven-dimensional pressure field comprising the impulse response of the virtual environment in time to simulated pulses emitted from the probe sources and received at listener locations. At a subset of defined probe source locations, and in some examples, each of the probe source locations, the simulation module 304 may conduct a wave simulation by placing a sound source at the probe source location that yields a four dimensional slice ($P_{x_s}(x_l, t)$) of the seven-dimensional pressure field ($P(x_s, x_l, t)$) for each probe source location. As used herein, virtual means a computerized representation and, as used herein, environment means a physical or virtual environment.

At 504, the computing resource encodes the impulse response field. The computing resource may extract parameters corresponding to phasic characteristics of the impulse response discussed above from the simulated impulse response field, rather than attempting to store the chaotic impulse response field in its entirety or reduce the sampling rate for the impulse response field. For example, at 504, the computing resource may look up the impulse responses for a subset of probe source/listener pairs, $P_{x_s, x_l}(t)$ and extract four time-insensitive (or "time-implicit") parameters from the subset of impulse responses. In an example parameterization, the seven-dimensional pressure field, $P(x_s, x_l, t)$, would reduce to four three-dimensional, discrete parameter fields, $\{F_{x_s}^{param}(x_l)\}$, per probe source calculated, where param may be the set of four parameters extracted (in other words the computing resource outputs four parameter fields concatenated over the probe source locations). For example, the computing resource may extract the direct sound loudness, early reflection loudness, early decay time, and late reverberation time since directionality, pitch, attenuation, and other characteristics may be calculated separately from the impulse response, being dependent on other factors. In some examples, the computing resource may additionally parameterize one or more of a point in time at which early decay time starts and ends and late reverberation time starts (i.e., when early reflection slope becomes late reverberation slope), peak density, noise of the impulse response, envelope characteristics, environment flags (e.g., indication of whether the environment is "outdoor" or "indoor" environment), parameter accounting for how other parameters vary in regard to frequency, and directionality (e.g., accounting for where perceived sound seems to emanate from). The computing resource may further encode, smooth, spatially sample, quantize, and/or compress the parameter fields to obtain encoded parameter fields.

At 506, the computing module receives audio signal(s) to be emitted from source location(s) and played back at a listener location. The source location(s) may vary in time or they may be static in time. The computing resource decodes the encoded parameter fields to obtain parameters of an impulse response for a particular audio signal source location and a particular listener location, even if either or both of those locations are between source probe locations. For example, the computing resource may insert the source location(s) into a grid comprising the source probe locations defined beforehand. As discussed similarly above in regard to decoding module 306, the computing resource may interpolate parameters for source/listener pair(s) from the encoded parameters fields for the probe sources surrounding the source location(s) inserted into the grid. In some examples, at 506, instead of interpolating parameters from the encoded parameter fields of the probe sources surrounding the source location(s), the computing resource may make use of acoustical reciprocity and interpolate parameters from the encoded parameter fields for the probe sources surrounding the listener.

Once decoded (and interpolated) parameters are received, the computing resource may use the decoded parameters to calculate weights to scale the arbitrary audio signal to be emitted at the source location and played back at the listener location. In at least one example, the computing resource may calculate weights as a function of a subset of the parameters so that a sum of CFs scaled by the weights results in a filter constrained by the decoded parameters. In one example, the computing resource may not scale the CFs and may convolve the CFs with a weighted sum of source signals (if there are multiple source signals). In an example where there are multiple source signals, the computing resource may receive decoded parameters for a listener location; calculate weights based at least in part on the source locations and the decoded parameter; scale source signals by the calculated weights; sum the scaled source signals; convolve the summation of scaled source signals with the canonical filters; and sum the convolved summation of scaled source signals. In at least one example, before convolution the source signals may be copied into copies and the copies may be weighted with different weights before the computing resource sums and convolves the weighted copies with the CFs. In some examples, the copying may result in non-identical copies. In at least one example, propagation of an arbitrary audio signal (play back at a listener location of an arbitrary signal emitted at source location(s)) may be computed at run-time.

Figure 6:
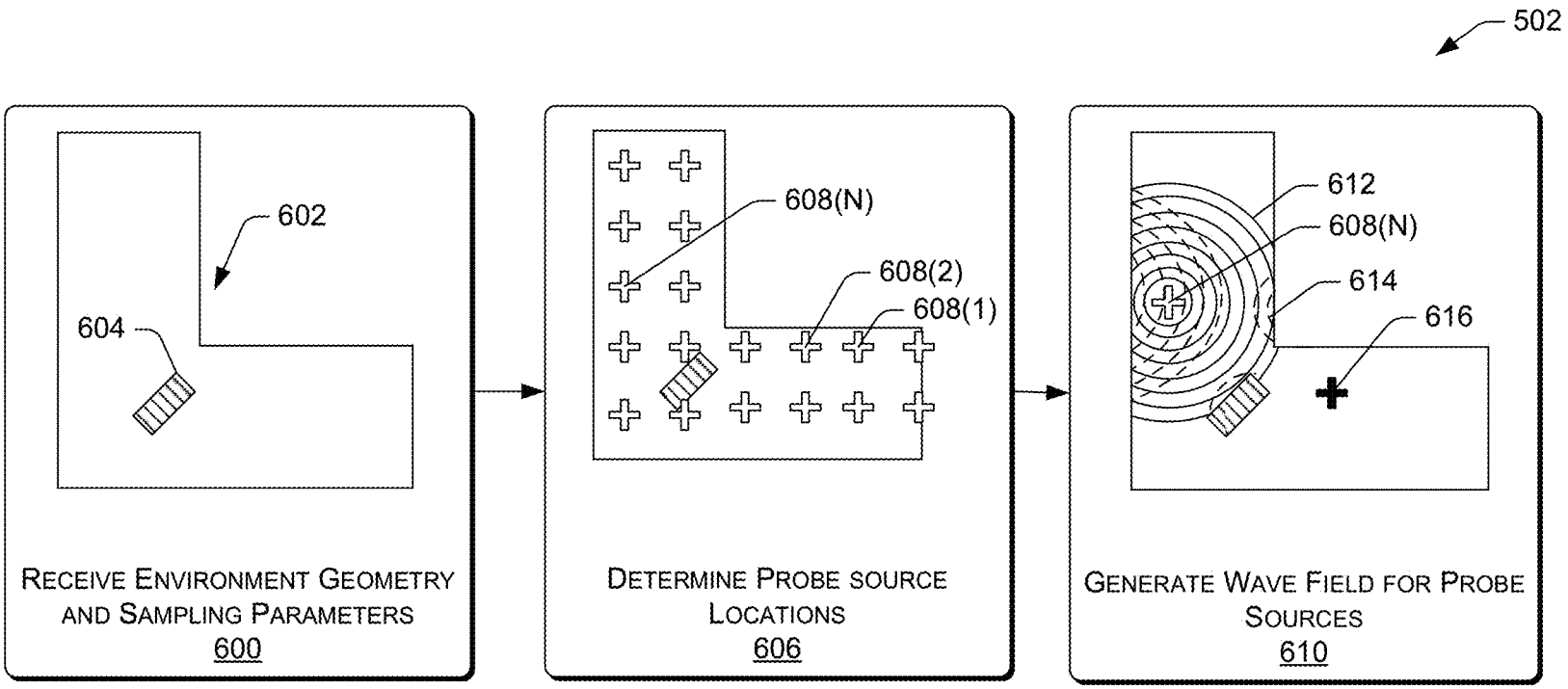
FIG. 6 is a flow diagram illustrating an example process of simulating a pressure field in an environment.

FIG. 6 depicts the process 502 introduced in FIG. 5. In at least one example, the computing resource simulates the impulse responses of a virtual environment to a pulse emitted from probe source locations. At 600, the computing resource receives environment geometry (depicted as example environment geometry 602) (e.g., voxelized environment polygons, voxelized environment triangles, environment wire frame model) of a virtual environment that may have associated material data (e.g., material codes). Associated material data may comprise information regarding the manner in which the specified material interacts with sound of different frequencies (e.g., scalar value, attenuation value, impulse response, transverse wave data, etc.) or for simplicity may be an absorption or reflection coefficient that does not vary with frequency. It may be acceptable to utilize an absorption or reflection coefficient since the absorption or reflection of many materials either exhibit variance at extreme ends of the spectrum of human hearing or are not easily perceived or distinguished by the human brain. In various examples that utilize an absorption or reflection coefficient, computation time and storage required to perform this example technique may be reduced. In the example shown, example environment geometry 602 includes an "L"-shaped configuration of walls and a construction feature 604. The construction feature represents an obstruction such as, for example, a column, piece of furniture, box, or building and/or construction features such as a wall, door, or window. In practice, the environment geometry 602 may be much more complex, but for the sake of visualization environment geometry 602 is illustrated. The computing resource may automatically determine sampling controls such as, for example, a maximum simulation frequency (which may be related to cell size), cell size, and voxel size (which may be related to the cell size). The determination of the maximum simulation frequency may be based on memory and computation constraints, among other considerations. Alternatively, an I/O, capture, communication device, or a user could specify the sampling controls and/or environment geometry.

At 606, the computing resource receives or determines a number of probe source locations 608. The computing resource or a user may specify uniform spacing of the probe source locations in the horizontal and vertical directions of the virtual environment. Other techniques may be used to define the probe source locations. For example, in a video game application of these techniques, a user may specify a horizontal spacing of 2 to 4 meters and a vertical spacing of 1.6 meters of probe sources, seeing as, in this example, a virtual player's height may be specified to be 1.6 meters tall. The user may also specify that probe sources be placed throughout the confines of the environment, including regions that could not be reached by the virtual player on foot in order to account for large vehicles, flying abilities, rag doll physics effects that respond to in-game events that may send the virtual player to obscure portions of the virtual environment, and other such game dynamics. The probe source locations may be chosen to include the locations in the virtual environment that a listener may exist or a subset of the locations. For example, region-of-interest meshes may constrain probe samples to the interior of the environment. Region-of-interest meshes may be voxelized to compute a discrete union of the interiors of the virtual environment. Any probe sample whose corresponding voxel lies outside the region of interest or within environment geometry may be rejected. When acoustical reciprocity is used to calculate the propagated audio signal, which requires switching the source and listener positions, listener navigation may be emphasized when choosing probe source locations.

At each probe source, $x_s \epsilon x_s$, the computing resource simulates in a geometric shape around it since sound attenuates due to occlusion/absorption and with distance. For example, the computing resource may use a vertical cylinder with a specified radius and top and bottom heights (e.g., 45 meter radius and 14-20 meter height, which is roughly the diameter of a city block and the height of a 4 to 5 building floors). The propagation by 50 meters results in a pure distance attenuation of −34 dB relative to the loudness at 1 meter. In at least one example, the computing resource may add a padding layer of air around the geometric region, which aids in run-time extrapolation. The computing resource (or a user) may keep the thickness of the padding larger than the listener sample spacing used during encoding. In at least one example, the entire outer surface of the geometric region is marked as "fully absorbing" to model emission into a free field, thereby composing a simulation region. The computing resource may invoke the wave simulator in the simulation region. The outer region of the geometric region is later referred to as the maximal spatial constraint for the simulation.

Since the field to be simulated varies with time, a time constraint for the simulation may be chosen. In at least one example, rather than storing the entire impulse response, the computing resource may store portions of the impulse response that correspond to the manner in which the human ear and brain process sound. In particular, the computing resource may capture three transient phases of an acoustical impulse response: the direct sound, such as 612; early reflection, such as 614; and late reverberation, such as 702. Therefore, the time constraint for the simulation ran by the computing resource may provide enough time to capture these phases of the impulse response plus time and to account for line-of-site delay from the probe source to the maximal spatial constraint of the geometric region specified above ($t_{max}=\Delta_{DS}+\Delta_{ER}+\Delta_{LR}+\Delta_C$), where the variables represent the durations of the direct sound, such as 612; early reflection, such as 614; and late reverberation, such as 702 phases of the impulse response respectfully and $\Delta_C$ accounts for the line-of-sight delay from the probe source to the maximal spatial constraint).

For example, the time constraint may be set to approximately one second assuming that the direct sound portion of an impulse response, such as 612, may be approximately 5 milliseconds; the early reflections portion, such as 614, of an impulse response vary approximately between 100 and 200 milliseconds depending on the environment geometry and material and locations of the source and listener; and the later reverberations portion of an impulse response, such as 702, may carry on for some time depending on the environment volume and surface area. In some examples, the particular lengths of the phases may vary based on an environment type. In at least one example application for video games, assuming a direct sound phase length of 5 milliseconds, such as 612; an early reflection time of 200 milliseconds, such as 614; and a remaining ~600 milliseconds for the late reverberation and line-of-sight propagation delay, $\Delta_C$, such as 702, may be sufficient for the techniques described herein.

At 610, the computing resource may use the constraints provided above, including, but not limited to, the virtual environment geometry and its associated material data, if available; sampling controls; probe source locations; and spatial and time constraints to solve the acoustic wave equation for a response of the virtual environment to pulses emitted from the probe source locations. In various examples, the linearized Euler equations may be used to calculate the entire simulation field, but the Euler equations require calculation of both pressure and a velocity vector, which is unnecessary for computation of an impulse response. In applications that require use of intermediate velocities, the linearized Euler equations may be used, but otherwise wave equations provide the sufficient pressure data and require less storage. Any wave equation simulator may be used to calculate the acoustic pressure in the virtual environment respondent to the probe source signal and any hardware may be used to conduct the calculation. For example, one may choose to use a graphical processing unit (GPU)-based adaptive rectangular decomposition (ARD) solver. In some examples, one may use pseudospectral time-domain algorithms in combination with a central processing unit (CPU) to calculate the pressure field resulting from the probe source signal.

Figure 7:
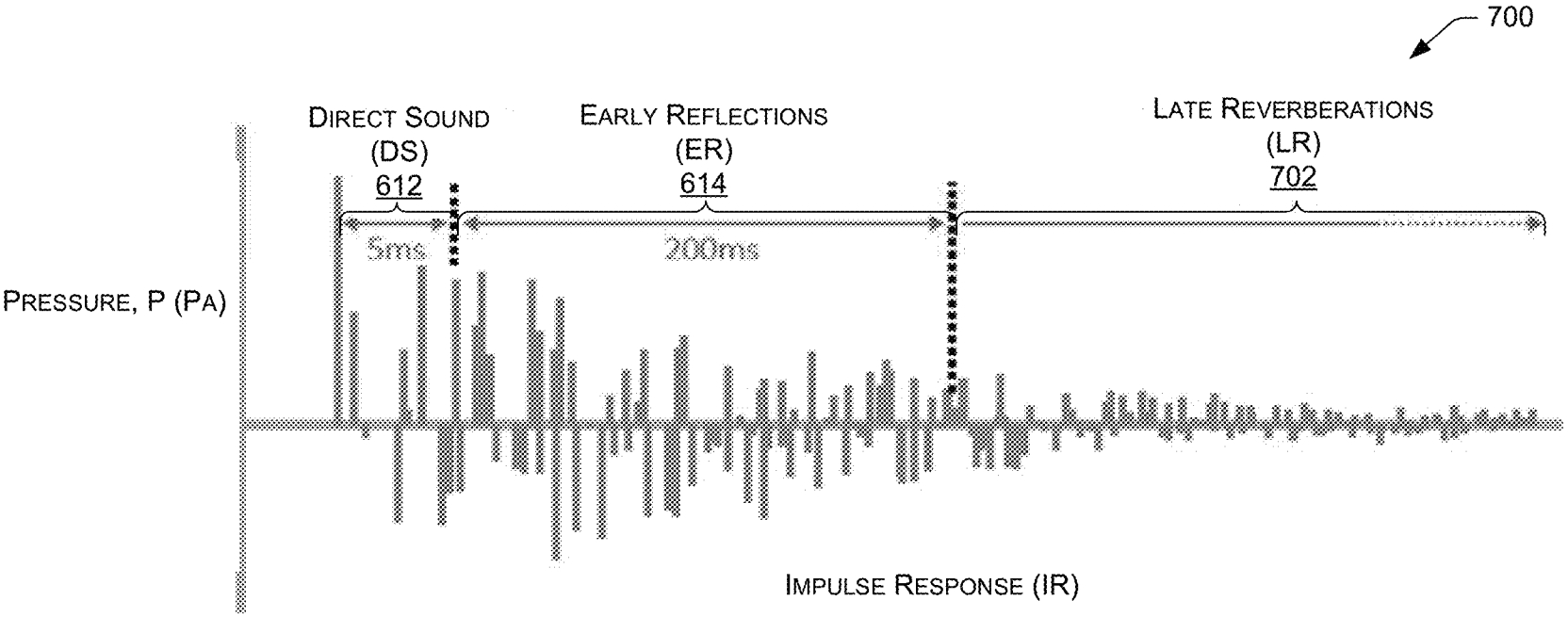
FIG. 7 is an example impulse response of an environment.

At 610, FIG. 6 depicts an example representation of a pulse being emitted by an example probe source 608(N) at 610 and the response of the example environment geometry 602, part-way through the simulation in time for the probe source 608(N). The solid lines indicated by 612 depict the direct sound of the pulse as it propagates through space. The dashed lines indicated by 614 depict early reflections from the example environment geometry 602 (the late reverberation is not depicted because as yet, in time and in this example, they have not occurred yet). The resulting air pressure amplitudes at potential listener location 616 that vary in time based on the direct sound of the pulse, the early reflections of the pulse, and the late reverberation from the pulse. Once the simulation finishes, the resulting air pressure amplitudes varying in time at potential listener location 616 compose an impulse response of the example environment geometry 602 for that particular probe source 608(N) and potential listener location. FIG. 7 depicts a schematic impulse response 700 for a particular probe source and listener location. As illustrated in FIG. 7, time of the impulse response is not to scale. In some examples, the amplitudes could be measured in units other than Pascals and could be magnitudes of different types. The example impulse response 700 comprises amplitudes that vary in time. The amplitudes may be grouped in three time-phases, as discussed above: direct sound 608, early reflections 614, and late reverberation 702.

The example impulse response 700 is the impulse response (or response of the environment to a pulse) for just one source/listener pair. An acoustical response of the virtual environment to the pulses emitted from the plurality of probe source locations may be a seven-dimensional pressure field denoted by the function shown below, where P is the calculated pressure field also referred to here as the entire simulation field; $x_s$ and $x_l$ are the source and listener locations; and t is time.

$$P(x_s, x_l, t)$$

As the example pressure field function describe above indicates, the entire simulation field, P, may be a function of source location, listener location, and time. In order to derive the entire simulation field, a pulse may be introduced at each probe source location $x_s$ (608(N)). One such example pulse that may be used is described by the equation below, where $\tilde{s}(x, t)$ is the source pulse; x and $x_s$ are drawn from voxel centers, $\sigma_s=\sqrt{\ln 10}/(\pi\nu_{max})$ (where $\nu_{max}$ is the maximum desired simulation frequency); and $t_0=5\sigma_s$.

$$\tilde{s}(x, t) = \gamma\delta(x, x_s)s(t),\ s(t) = \exp\left(\frac{-(t-t_0)^2}{\sigma_s^2}\right)$$

The pulse may be a Gaussian introduced at a single cell. The initial delay $t_0$ ensures a small starting amplitude (less than −210 dB relative to peak). The factor γ, normalizes the signal to have unit peak amplitude at a distance of 1 meter. For an ARD solver, γ may be set to equal 1/(0.4Δ), where Δ is voxel size. The choice of $\sigma_s$ forces the Gaussian's spectrum to decay by −20 dB at frequency $\nu_{max}$, limiting aliasing but still containing extractable information near $\nu_{max}$. The example pulse may be described as an omni-directional Gaussian pulse.

The simulated pressure field ($P(x_s, x_l, t)$) may be an impulse response field, but, for the sake of clarity, to differentiate between the impulse response field that varies as a function of the probe source locations, listener locations, and time ($P(x_s, x_l, t)$)—the response of the environment to a pulse emitted at any probe locations and received at any listener locations in time) and the impulse response field for a pulse emitted by one probe source that varies as a function of just listener location and time ($P_{x_s}(x_l, t)$—the response of the environment to a pulse emitted at a particular probe location and received at any listener location in time), the first field is referred to herein as the entire simulated field and the second field is referred to as an impulse response field. The response of an environment at a listener location to a pulse emitted from a particular probe source is referred to as an impulse response or an impulse response at a probe/listener pair ($P_{x_s,x_l}(t)$). Furthermore, the simulated wave field may be a pressure field.

In at least one example, after simulating the wave field, the computing resource stores the entire simulation field. Since an entire simulation field may occupy tens of terabytes of space, in some examples, a bifurcated or distributed computation system, may include one or more first computing resources to run the simulation and encoding, and one or more second computing resources, which may have lower memory and/or processing resources, to run the remaining computations, which require much less storage and computation due to the techniques employed herein. In various examples, distributed computing resources 102 and/or device(s) 106, as introduced in FIG. 1, may represent such first computing resources, and the specialized computing resource(s) 108 may represent such second computing resources.

Figure 8:
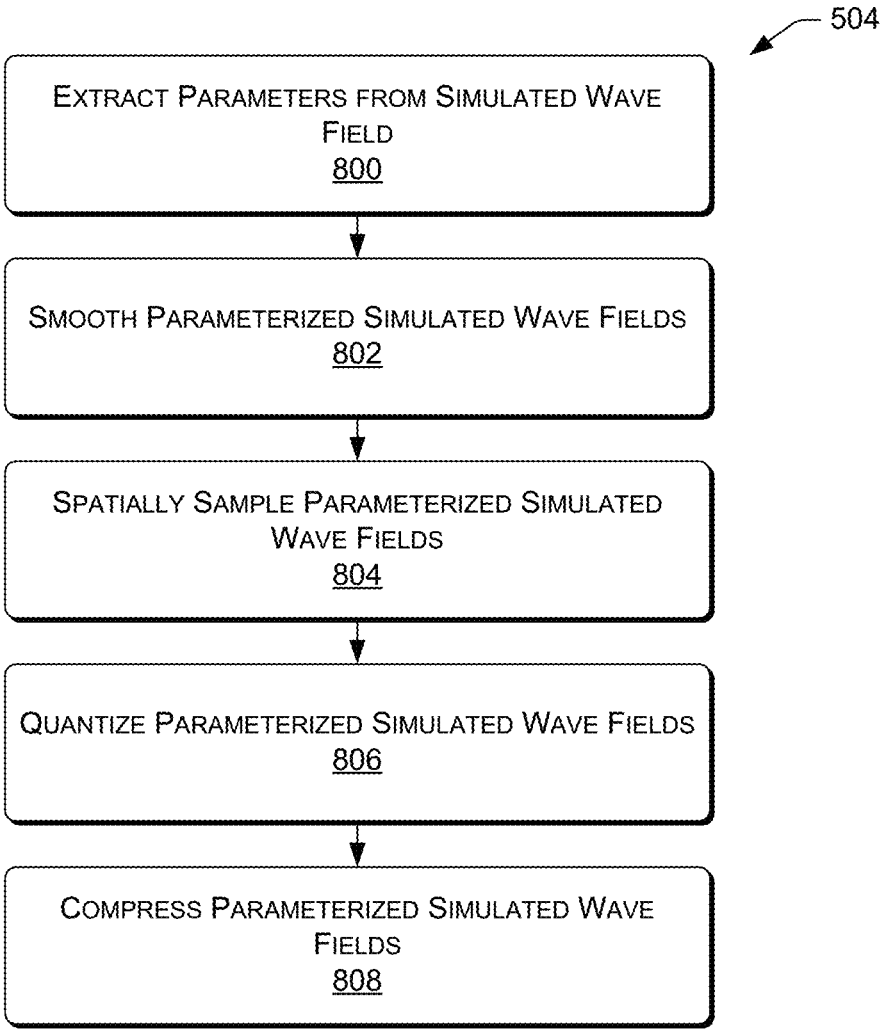
FIG. 8 is a flow diagram illustrating an example process of encoding a pressure field.

FIG. 8 depicts the process 504 introduced in FIG. 5. Encoding an entire simulation field as a parameter field (also termed parameterized impulse responses) may comprise parameter extraction (800), smoothing (802) and spatial sampling of extracted parameter fields (804), quantizing extracted parameter fields (806), and compressing extracted parameter fields (808). The process 504 may also include other processes such as encrypting and/or storing extracted parameter fields as an encoded output parameter field. In at least one example, the computing resource conducts a streaming read of the data in blocks, encodes each block, and writes out a corresponding 3D block composing the output parameter field (concatenating that 3D block to existing 3D blocks, where each 3D block may be concatenated over the probe source locations).

At 800, the computing resource may extract parameters independently from the impulse response received at each listener cell $x_l$. Extracting parameters enables storage and use of metadata to calculate the propagated audio signal for source/listener pairs at run-time rather than storing the entire impulse response for source/listener pairs. The parameters extracted may comprise the minimal perceptual parameters of the impulse response that realistically convey to a human mind a reproduction of the environment's response. These parameters may comprise direct sound loudness ($L_{DS}$), early reflection loudness ($L_{ER}$), early decay time ($T_{ER}$), and late reverberation time ($T_{LR}$) (late reverberation loudness may be derived from $L_{ER}$ and $T_{ER}$). The parameterization of the impulse response field of an environment is described by the equation below.

$$P_{x_s}(x_l,t) \mapsto \{F_{x_s}^{param}(x_l)\} \text{ where param } \epsilon\{L_{DS}, L_{ER}, T_{ER}, T_{LR}\}$$

More parameters may be extracted, but direct sound loudness, early reflection loudness, early decay time, and late reverberation time are the minimum characteristics of an impulse response to auralize propagated sound in a realistic manner. Such additional parameters may include direction of the perceived sound.

Figure 9:
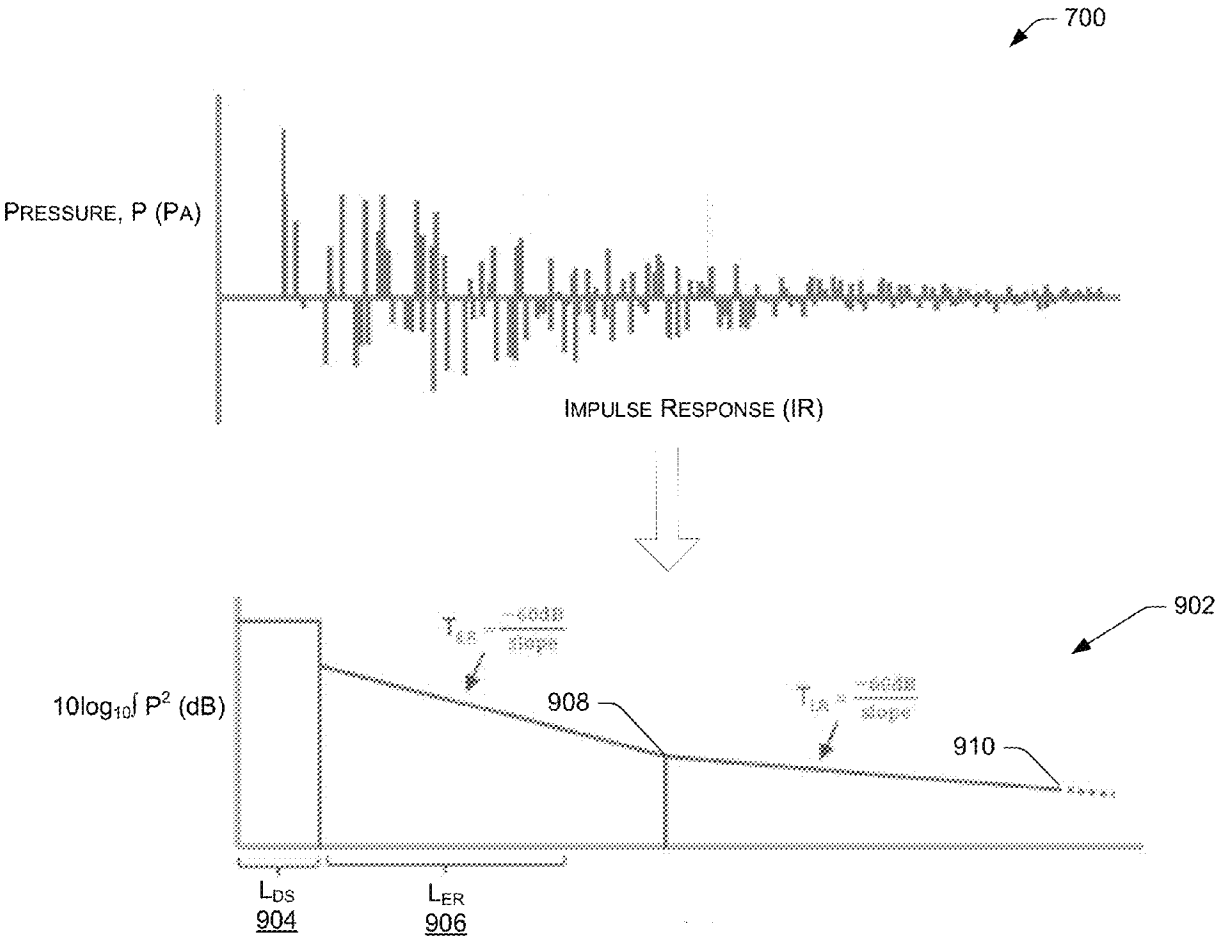
FIG. 9 is a schematic diagram illustrating extraction of parameters from an impulse response as shown in FIG. 7.

FIG. 9 depicts an example parameterized impulse response 902, the parameters of which were extracted from the example impulse response 700. In the example depicted in FIG. 9, four parameters were extracted from the example impulse response 700: direct sound loudness ($L_{DS}$) 904, early reflection loudness ($L_{ER}$) 906, early decay time ($T_{ER}$) 908, and late reverberation time ($T_{LR}$) 910. Parameterized impulse responses calculated using the techniques, such as described above in regard to 800, may exhibit greater smoothness than impulse responses from which parameters composing the parameterized impulse responses were derived. This increased smoothness may make the parameterized impulse responses more responsive to compression. In some examples, the parameterized impulse responses are smooth in space, making the parameterized impulse responses responsive to spatial compression. The example parameterized impulse response 902 exhibits greater smoothness than the example impulse response 700.

Returning to FIG. 8 at 802, in room acoustics, the direct path is nearly unoccluded in concert halls and the direct energy may usually be analytically estimated and removed. The computing resource may be enabled to capture more complex, scene-dependent occlusion, however. In order to do so, the computing resource may account for an initial delay before sound energy starts arriving at a listener location, $\tau(x_s, x_l)$. The initial delay may correspond to a geodesic path that may diffract around environment geometry and become attenuated. The computing resource may employ a definition of $\tau(x_s, x_l)$, as described by the equation below, where $D_\tau$ is the threshold of first arrival.

$$\tau(x_s,x_l)=\min_t\{10\log_{10}P^2(x_s,x_l,t)>D_\tau\}$$

A $D_\tau$ value that is too large may miss a weak initial response in an occluded situation. Too small of a $D_\tau$ value may cause $\tau$ to be triggered by numerical noise, which travels faster than sound in spectral solvers like ARD. One value for $D_\tau$ that may be employed by the computing resource may be −90 dB. The value of $D_\tau$ may be varied by approximately 10 dB without substantial impact on $\tau$. In at least one example, $\tau$ may be used to appropriately calculate the correct parameters for parameter extraction but may not be retained after extraction. In various examples, $\tau$ could be retained. Some people, for example video-game players, may mistake audio-visual asynchrony (delay before sound energy arrives) for system latency in the audio pipeline, motivating $\tau$ to not be retained as a design choice.

The computing resource may extract the direct sound loudness, such as 904, from the impulse response field. The term "direct sound" is standard in acoustics although the term "first arriving sound" is more physically accurate since its path may be indirect and its perceptual loudness may integrate other reflected/scattered paths that arrive within a few milliseconds of the shortest path. In one implementation, in order to examine the correct portion of the impulse response to identify the direct sound, the computing resource may assume the interval $t\epsilon[\tau,\tau+\Delta_{DS}]$, where $\Delta_{DS}$ may be chosen to be 5 ms based on known acoustics, contains the initial sound. In order to examine the direct sound of an impulse response, such as 612, a smooth windowing function may be applied to the impulse response since employing a step function in the time domain results in Gibbs ripples which contaminate the spectral processing conducted later in the extraction. In at least one example, the computing resource may use a Gaussian error function, defined as $$w(t) = \frac{1}{\pi\sigma_w}\int_{-\infty}^{t}\exp\left(\frac{-t'^2}{\sigma_w^2}\right)dt'.$$

In at least one example $\sigma_w$ may be fixed to equal $S_w\sigma_w$, where $\sigma_w$ is the Gaussian source signal's standard deviation and $S_w$ is a partitioning window width factor. The proportionally constant $S_w$ controls the smoothness of the partitioning (e.g., $S_w$ could be set to equal 3 for example). The error function w(t) grows monotonically from 0 to 1 without oscillation, may be controllably compact in time, and provides a straightforward partition-of-unity w(t)+(w−t)=1. The complementary window may be denoted w'(t)=w(−t).

Figure 10:
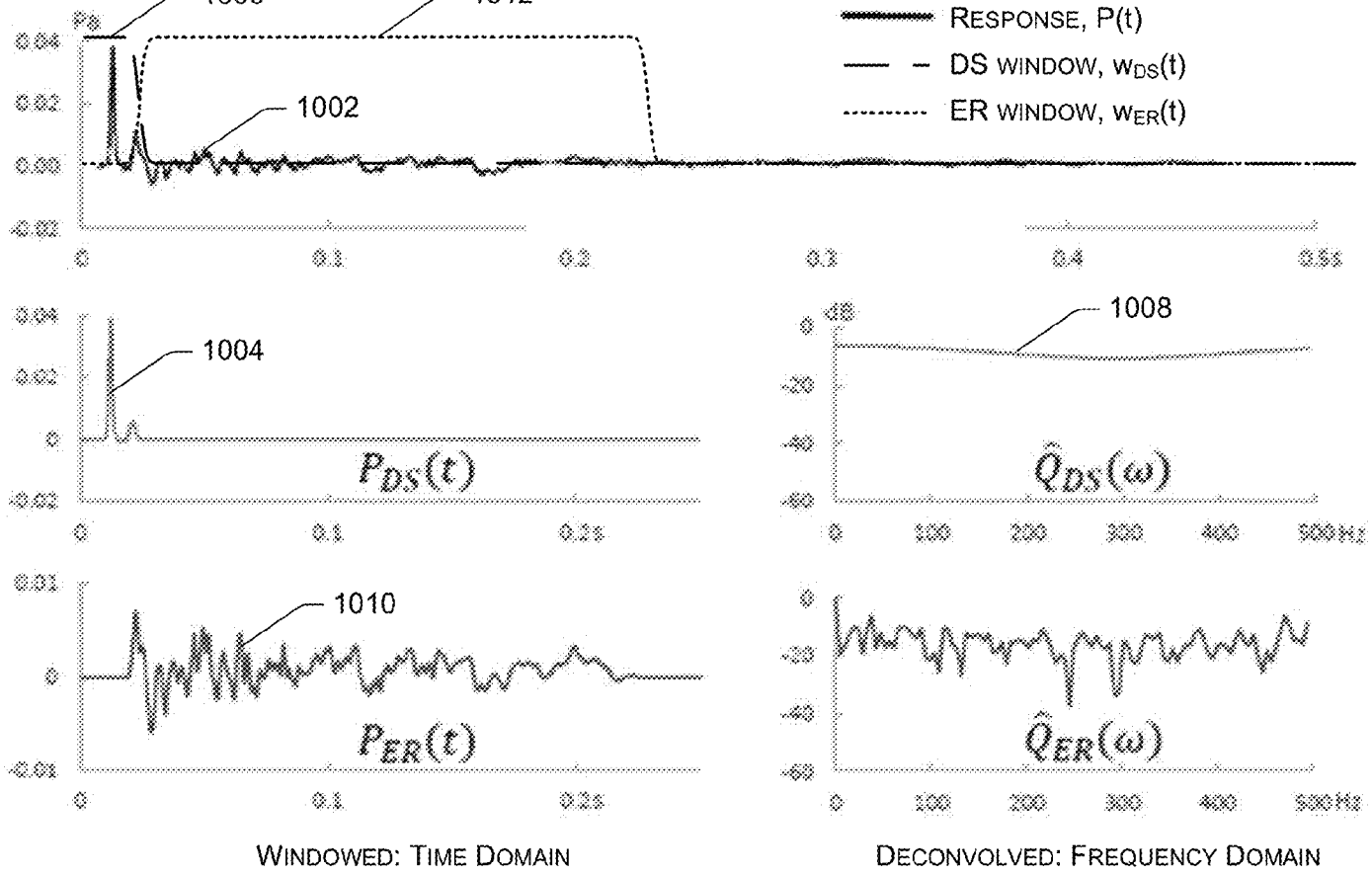
FIG. 10 is a diagram of example graphs of an impulse response, window functions, windowed impulse responses, and deconvolved windowed impulse responses.

FIG. 10 depicts an example method of one example that applies windows to an impulse response 1002 in order to isolate phases of the impulse response corresponding to the direct sound, such as 612; early reflections, such as 614; and late reverberation, such as 702. In this example, in order to estimate direct sound loudness, such as 904, from an impulse response, the computing resource may first extract the segment $P_{DS}(t)=P(t)w_{DS}(t)$ (element 1004), where $t\epsilon[\tau,\tau+\Delta_{DS}+4\sigma_w]$ and the time window $w_{DS}(t)=w'(t-\tau-\Delta_{DS}+4\sigma_w)$ (element 1006) (notation for $P(x_s, x_l, t)$ simplified to P(t) for this section). Next, in this example, the computing resource transforms the signal to the frequency domain to obtain $\hat{P}_{DS}(\omega)$ and deconvolve it with the source signal to obtain the underlying frequency response $\hat{Q}_{DS}(\omega)=\hat{P}_{DS}(\omega)/\hat{s}(\omega)$ (element 1008). Finally, the computing resource computes the energy over bands between the set of $n_\nu$ octave frequencies (in Hz in one implementation) $\nu_i=\{62.5, 125, 250, 500, \ldots, \nu_{max}\}$, via $$\{L_i^{DS}\} = 10\log_{10}\left(\frac{1}{\nu_{i+1}-\nu_i}\int_{\nu_i}^{\nu_{i+1}}\left\|\hat{Q}_{DS}(2\pi\nu)\right\|^2 d\nu\right).$$

Direct sound loudness averages these:

$$F^{L_{DS}} = \frac{1}{n_\nu}\sum_i L_i^{DS}.$$

In this example, the computing resource does not deconvolve the entire input signal to convert a Gaussian response to an impulse response, but may instead first windows in time and deconvolves in the frequency domain where energy may be estimated directly via Parseval's theorem. Not deconvolving the entire input signal avoids Gibbs ringing that arises when deconvolving a band-limited response. Gibbs ringing may overwhelm properties of a band-limited response, especially when the direct pulse has high amplitude (i.e., when $x_l$ is close to $x_s$).

The computing resource extracts the loudness parameter for the early reflections ($L_{ER}$), such as 906, similarly. In at least one example, the computing resource extracts the early reflections interval, such as 614, from the response P(t) via $P_{ER}(t)=P(t)w_{ER}(t)$ (element 1010) where $t\epsilon[\tau+\Delta_{DS},\tau+\Delta_{DS}+\Delta_{ER}+4\sigma_w]$ and $w_{ER}(t)=w(t-\tau-\Delta_{DS}-2\sigma_w)w'(t-\tau-\Delta_{DS}2\sigma_w)$ (element 1102). In at least one example, the computing resource may extract the energy as described above for direct sound.

The computing resource may extract early decay time ($T_{ER}$), such as 908, from the impulse response field. Early decay time and the late reverberation time ($T_{LR}$), such as 910, account for the decay of the energy profile of reverberation in a space. Two parameters, rather than just one are used to account for the decay because steeply decaying initial reflections are often followed by more slowly decaying late reverberation, such as 702. Furthermore, the early decay time, such as 908, strongly depends on the environment geometry and on the locations of the source and listener ($x_s$, $x_l$), whereas the late reverberation time, such as 910, depends at least in part on an environments volume and surface area. The late reverberation time, such as 910, also correlates well with subjective reverberance for impulsive sources such as a gunshot or clap, while for continuous sources such as speech and music, early decay time may be a better measure. Utilizing two parameters to account for the two decay rates in these two phases not only accounts for the impulse response characteristics but emulate the manner in which the human ear and brain perceive sound. Therefore, only using one parameter for the decay may not properly auralize the propagated sound and therefore an example implementation extracts both parameters from the impulse response field.

In at least one example, the computing resource uses the backward (Schroeder) integral, defined as $\tilde{I}(t)=\int_t^{\infty}P^2(t)dt$. In at least one example, the straight-line model may be used to estimate the reverberation time. In some examples, a non-linear regression model may be used. For some example techniques described herein, noisy estimation of reverberation time is unlikely to affect auralization of the propagated audio signal in a manner that would be noticeable by human ears.

In at least one example, the computing resource estimates the reverberation time in a single octave band (e.g., 250-500 Hz band for which the response first needs to be band-passed—band-passing the entire response works poorly, as it introduces ringing that contaminates the weak signal near its end). In at least one examples, the computing resource could estimate the reverberation time in multiple octave bands. In order to identify the beginning of the energy decay, the direct sound, such as 612, may be time-windowed out, based on the general assumption that there is a discontinuous drop in the energy decay curve after the direct sound, such as 612, has reached the listener.

$$P\neg_{DS}(t)=P(t)w(t-\tau-\Delta_{DS}-2\sigma_w)$$

In this example, short-time Fourier transform may be used, although other transforms such as the wavelet transform, the Gabor transform, and multiresolution analysis, among others, may be used for high-frequency applications.

In at least one example, for spectral analysis, the simulation module 304 uses a sliding Hamming window of a suitable width to sample the decay (e.g., 87 ms, which correlates to 256 samples for a $\nu_{max}$ of 500 Hz) and to achieve a significant overlap (e.g., 75%). For each translation of the window starting at time $\tau$, the computing resource multiplies the window against $P\neg_{DS}$ and computes the fast Fouriet transform (FFT) of the windowed segment. The computing resource takes the spectrum's sum of squared magnitudes in the examined octave's band, yielding the energy E(t). The energy decay curve applies the chosen integration method or model (e.g., the Schroeder integral). When the Schroeder integral is used, the resultant energy decay curved may be described as $I(t)=10\log_{10}\int_t^{t_{max}}E(t)dt$, where $t_{max}$ denotes the termination time of the simulated response (equivalently, entire simulation, as used herein) P. Combining the time-windowed short-Fourier transform described above with the integration yields a smooth curve. In at least one example, this smoothing facilitates slope estimation.

In an example that first removes the direct sound portion of the response, a plateau may be present in I(t) near t=0, which is not present in the true decay. Therefore, to find the true decay, the computing resource may delay its calculation of decay until a second point time, $t_0$, when the amplitude sufficiently decreases (e.g., ignore initial portion of I(t) for purposes of analysis until the point in time at which I decays by −3 dB). The International Organization for Standardization (ISO) recommends using linear regression on the first 10 dB of the decay, so the computing resource may employ linear regression between $t_0$ and a second point in time, $t_1$, when the signal I has decayed another 10 dB from the amplitude at $t_0$. Other methods to calculate the early decay time may be used, however. In order to achieve the increased compression ratio and computation time described herein, the method chosen should output a scalar. In at least one example, the computing resource estimates the slope, $\delta_{ER}$, in the interval $[t_0, t_1]$ by forward differencing to obtain a time-varying slope, of which the computing resource takes the root mean squared (RMS), yielding the early decay time slope. Forward differencing and taking the root mean squared may be advantageous as opposed to linear regression because real decay curves are often concave, especially in outdoor environments. Linear regression, although simple, may underestimate the decay rate in such cases and thereby overestimate the early decay time. By taking the root mean squared of the forward difference, the initial fast decay is emphasized. The computing resource may calculate the time necessary for the energy to decay by 60 dB and set $T_{ER}=-60/\delta_{ER}$.

In at least one example, in order to extract the late reverberation time, such as 910, the computing resource may calculate the asymptotic decay time for I. In this example, the computing resource may use linear regression to find the slope of the end segment described by $t\epsilon[t_{max}-\Delta_{LR}, t_{max}]$ and set $T_{LR}=-60/\delta_{LR}$.

Figure 11:
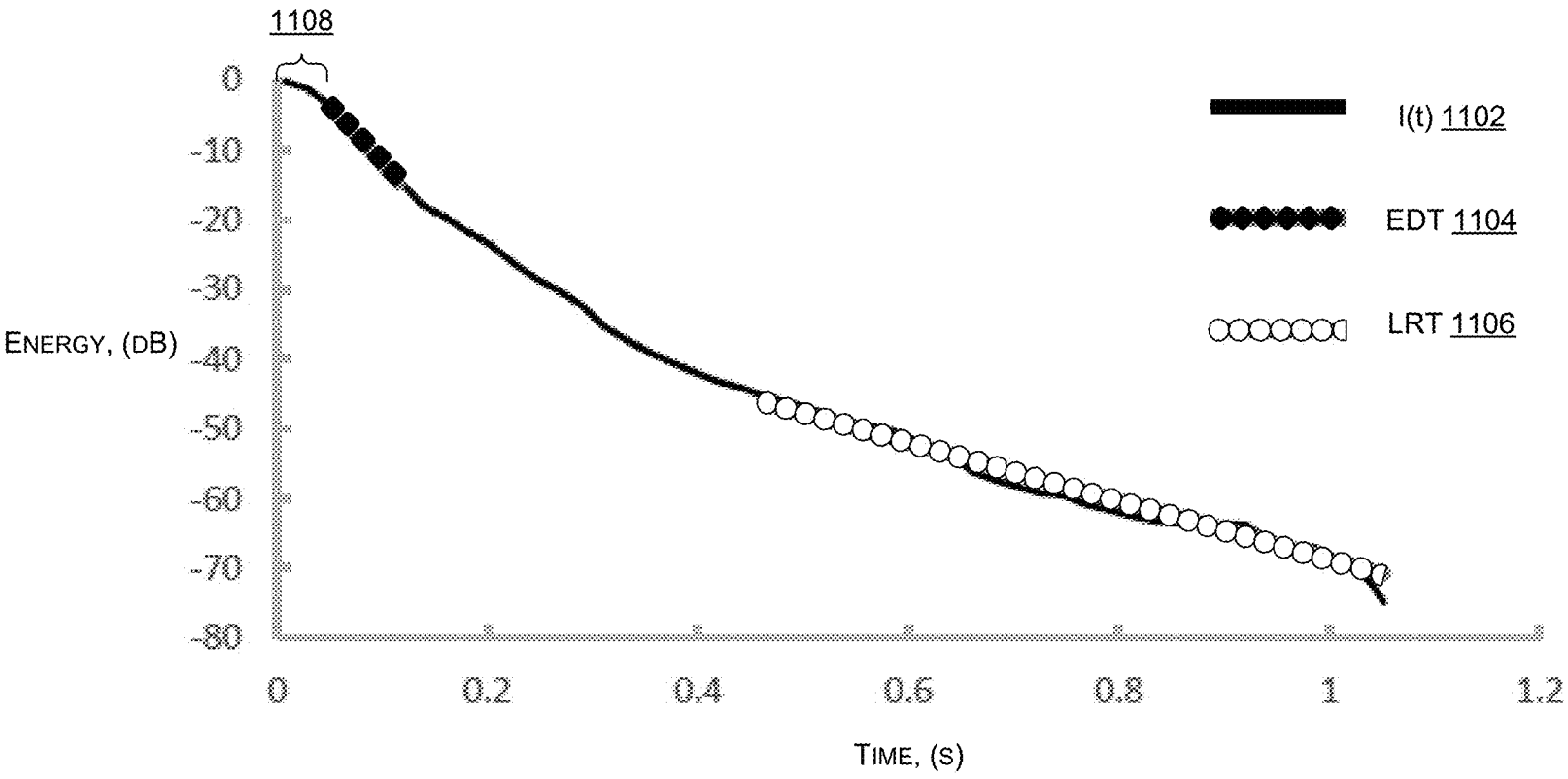
FIG. 11 is a diagram of an example energy decay curve, an early decay time slope, and a late reverberation time slope.

FIG. 11 is a graph of an example energy decay curve, 1102; an early decay time slope, 1104; and a late reverberation time slope, 1106. Using these slopes, the early reflections time, such as 908, and late reverberation times, such as 910, may be estimated. Note the example delay 1108 before the early decay time slope may be calculated.

Raw wave field data (the simulated seven-dimensional pressure field) for just one scene in a video game (or by analogy to other contexts, one complex environment) takes up tens of terabytes of space. Parameterization enables compression resistant, finely-sampled impulse fields to be characterized and thereby yield a compression factor of over a million after further encoding. For example, one scene with total seven-dimensional wave data of 56 TB was compressed to 41 MB. As used herein, finely-sampled may vary depending on the application. In at least one example, finely-sampled may be equal to or finer than a sampling of, for example, 25 centimeters in all cardinal directions. As scenes get larger, encoded parameter field size scales as a function of the scene's surface area rather than its volume. The dimensionality of the results indicates that a further dimension has been removed in addition to time, going from seven dimensions (volume×volume×time) to five dimensions (volume×area). Therefore, the encoded parameters field size scales linearly with the surface area of the bounding cylinder. The unencoded size of the impulse response field may scale with scene volume, and therefore has super-linear growth in surface area. Surface area scaling may be optimal when directly encoding wave fields as expressed in the Kirchoff-Helmholtz integral theorem; this represents the information in the boundary conditions.

After extracting the parameters (e.g., $\{L_{DS}, L_{ER}, T_{ER}, T_{LR}\}$ or others) for the impulse responses corresponding to one probe source and listener sample locations in the impulse response field, the computing resource prepares the extracted parameters composing parameter fields (e.g., in an example where four parameters are extracted, four parameter fields result from the extraction—one field per parameter where the locations within the field correspond to listener locations, $x_l$, for a fixed probe source location, $x_s$) for further processing, such as, for example, quantization and compression. In particular, direct sound loudness ($L_{DS}$), such as 904, exhibits a singularity at the probe location, $x_s$, due to distance attenuation, so encoding module 304 may encode the extracted direct sound loudness value(s), such as 904, of the parameter field relative to the free-field attenuation of a monopole source. In order to encode the extracted direct sound loudness value, such as 904, pursuant to this example, the extracted direct sound loudness value(s) may be updated via $F_{x_s}^{L_{DS}}(x_l) \leftarrow -20 \log_{10}\|x_l - x_s\| + F_{x_s}^{L_{DS}}(x_l)$. Encoding the extracted direct sound loudness, such as 904, in this manner improves compression and reduces the dynamic range. In at least one example, the computing resource encodes the loudness parameters in logarithmic space and clamps them to a defined range (e.g., −70 dB to +20 dB, as a conservative range since acoustic amplification due to wall reflections rarely exceeds +6 dB and the audability of a source with loudness 80 dB SPL at 1 meter decays to barely audible at 10 dB SPL). In at least one example, the computing resource may also encode the decay time parameter ($T_{ER}$ and $T_{ER}$) in logarithmic space as well via log $T_{ER}$/log 1.05 for example, where the denominator ensures 5% relative increase between consecutive integral values. In this example, the computing resource may clamp the parameters against their bounds (e.g., using a range of −64 to 63, representing 44 ms to 21.6 s). In at least one example, the encoding module may smooth and subsample the parameter fields at 802 and 804, respectively (e.g., using a box filter over the simulated samples). The computing resource may coarsely sample smoothed and subsampled parameters fields with little aliasing.

According to the ISO, the perceptual just-noticeable-difference (JND) may be 1 dB for loudness and 5% relative for decay times, under critical listening conditions. In at least one example, the computing resource logarithmically maps the loudness and/or decay time parameters so that resulting quantum(s) corresponds to one JND at 806 ($\Delta q=1$ dB and 5%). Quantizing the parameters allows each mapped scalar parameter to fit into one byte. In at least one example, the computing resource may logarithmically map the loudness and/or decay time parameters more conservatively for less critical listening conditions such as video game audio. Therefore in the video game context, the quantization threshold, $\Delta q$, may be increased (e.g., increase from 1 to 3 integral steps, which corresponds to 3 dB for loudness and 15% increment for decay times). Increasing the quantization threshold increases the compression ratio (e.g., where the quantization threshold may be increased from 1 to 3 integral steps, compression ratio increases by a factor of two).

The computing resource may compress the parameter fields at 808. In at least one example, the four parameter fields may be treated as a three-dimensional array with a bulkhead code (i.e., the don't care code, at least in part) indicating the presence of geometry. In at least one example, the computing resource may consider two-dimensional Z slices of a parameter field separately, where Z represents the gravitational upwards direction. Depending on the particular application, an axis other than the Z axis could be chosen. Encoding the parameter fields in two-dimensional slices allows for a few slices to be decompressed at run-time if a listener persists at roughly the same height while moving through an environment, rather than the whole parameter field. In some examples, the computing resource may compress the three-dimensional parameter field without choosing any such axis.

In at least one example, the computing resource may compress the parameter fields according to PNG (other lossless image compression techniques such as or similar to MNG, TIFF, GIF, entropy encoding, DPCM, chain codes, PCX, BMP, TGA, or other lossy techniques where the errors can be carefully controlled, such as JPEG or others; highly lossy techniques are likely to create audio artifacts in the auralization). In various examples, other image or video compression methods may be used. In at least one example, the computing resource may consider each X scanline in turn, accumulating a residual, r, representing the as-yet unquantized running difference. In examples where quantization is utilized, the computing resource keeps r below the quantum, $\Delta q$. In this example, during compression the computing resource maintains the previously processed field value f' and the current field value f, and subtracts to yield the running difference $\Delta f = f - f'$. Initially, $f' = r = 0$. The computing resource computes the output, q, and updates the residual via $$q \leftarrow \left\lfloor \frac{\Delta f + r}{\Delta q} \right\rfloor, r \leftarrow r + \Delta f - q\Delta q.$$

The computing resource may use the scanline's previous value as the predictor. When a bulkhead is encountered, the computing resource sets f=f' producing the value q=0 over its span. The computing resource finally performs LZW compression using Zlib over the resulting stream of q values, although in some examples other compression algorithms might be used alternatively or additionally. Therefore, as a result of various combined examples, the computing resource, e.g., via an encoding module, may transform the impulse response field for each source probe into four three-dimensional parameter fields organized as a set of compressed Z slices, comprising encoded parameter fields. In one example, the encoded parameter fields are concatenated. In other words, the encoding module outputs a first set of compressed parameter fields for a first probe source, the number of compressed parameter fields being equal to the number of parameters extracted from the impulse response of an environment to a pulse emitted from the first probe source, and the encoding module concatenates a second set of compressed parameter fields to the first set of compressed parameter fields for parameters extracted from the impulse response of an environment to a pulse emitted from a second probe source.

The computing resource may perform the techniques described above in a parallel or massively parallel computation.

Figure 12:
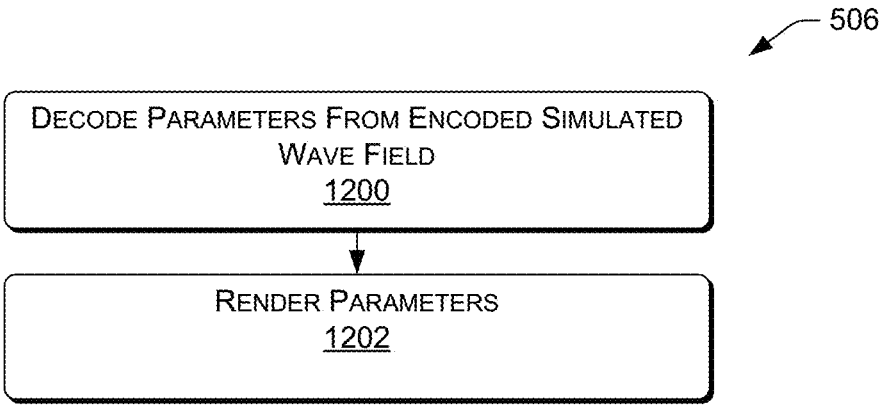
FIG. 12 is a flow diagram illustrating an example process of computing a propagated audio signal at run-time.

FIG. 12 depicts process 506 introduced in FIG. 5. At 506, the computing resource uses an encoded parameter field, raw wave data, or impulse responses to calculate a propagated signal at run-time. In an example where the process 506 uses an encoded parameter field, at 1200, the computing resource may insert probe locations into a spatial data structure (e.g., a grid) to accelerate lookup of eight probe sources forming a box around the inserted probe location (e.g., the location of an audio signal source at run-time ("run-time source")), where the eight probe sources may be a subset of the probe sources described above. Some of these eight probe sources may be missing because they lie inside environment geometry (e.g., inside a wall) or outside the specified region of interest. In at least one example, the computing resource may further remove probes that are "invisible" to the run-time source to avoid interpolating across occlusive geometry (e.g., walls). In order to do this, the computing resource may use a finely-sampled voxelization of the scene. The computing resource may renormalize the tri-linear weights of the resulting set of probe sources (of which there will be less than or equal to eight).

The computing resource may also compute the parameter value at the listener by tri-linearly interpolating. In at least one example, the parameter field may be a three-dimensional parameter field organized as a set of compressed Z slices. In this example, the computing resource may decode two slices spanning the listener location via LZW-decompression (or the appropriate decompression correlating with the compression chosen) and de-quantize the two slices by reversing the quantization discussed above, $$q \leftarrow \left\lfloor \frac{\Delta f + r}{\Delta q} \right\rfloor, r \leftarrow r + \Delta f - q\Delta q,$$

to obtain a two-dimensional array for the parameter corresponding to the parameter field being decoded.

In at least one example, the computing resource may interpolate over the 8-sample box around the listener. Invalid samples may be removed in the same way as for probe sources and the weights renormalized. Renormalized weights yield the (sampled) probe's parameters at the continuous listener location. The entire process represents six-dimensional hyper cube interpolation. The computing resource may also store decompressed Z-slices in a global cache with a least-recently-used policy to accelerate computation time.

In at least one example, the principal of acoustic reciprocity may be implemented to increase performance by reducing the number of fields to be decoded from, at most, eight multiplied by the number of sources to at most eight. Acoustic reciprocity dictates that the impulse response between a point source and point listener remains the same if these locations are interchanged and the same holds for acoustic parameters. Therefore, at run-time, the computing resource may exchange the source and listener location and apply the procedure described above. In other words, in this example the listener becomes the source, and the problem may be converted from multiple-source single-listener to multiple-listener single-source. Therefore, in at least one example, the computing resource may decode the valid probes around the listener, rather than the valid probes around the sources, which could far exceed just one source.

Once the computing resource decodes the parameter field to calculate the parameters between a source point and listener point (in one example, using the example discussed above utilizing acoustic reciprocity during decoding), the computing resource applies an acoustic filter for each run-time source-listener pair at 1202, rendering the parameters and thereby achieving the perceptual effect of the environment of the audio signal propagated from the source to the listener. The acoustic filter applied by rendering module 308 for each run-time source-listener pair has characteristics confined by the decoded parameter values corresponding to the impulse response of an environment between the interpolated probe source locations and the interpolated listener location (i.e., characteristics of the impulse response of the environment between the weighted sum of the probes surrounding the run-time source and the weighted sum of the probes surrounding the run-time listener).

Figure 13:
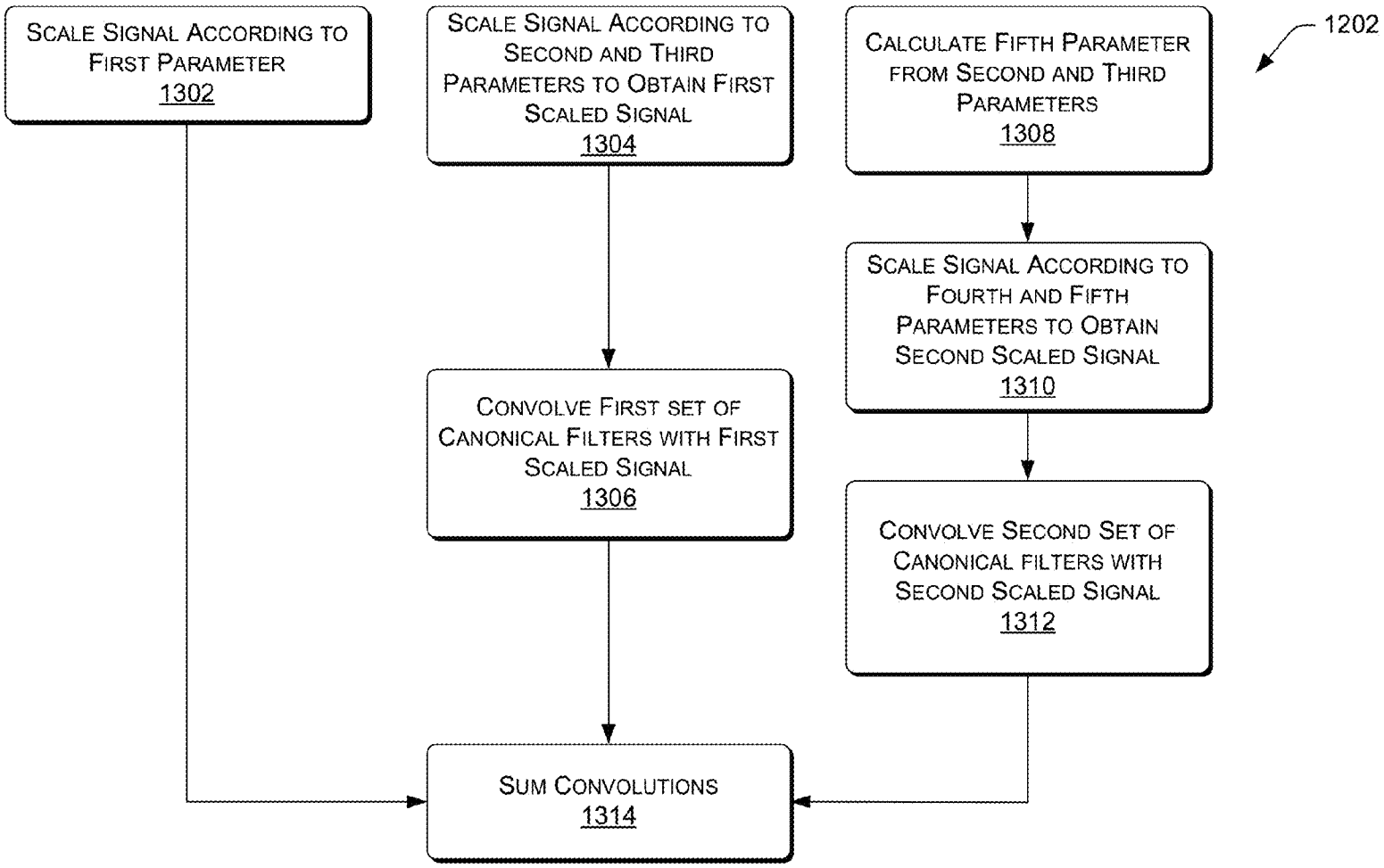
FIG. 13 is a flow diagram illustrating an example process of rendering parameters.
Figure 14:
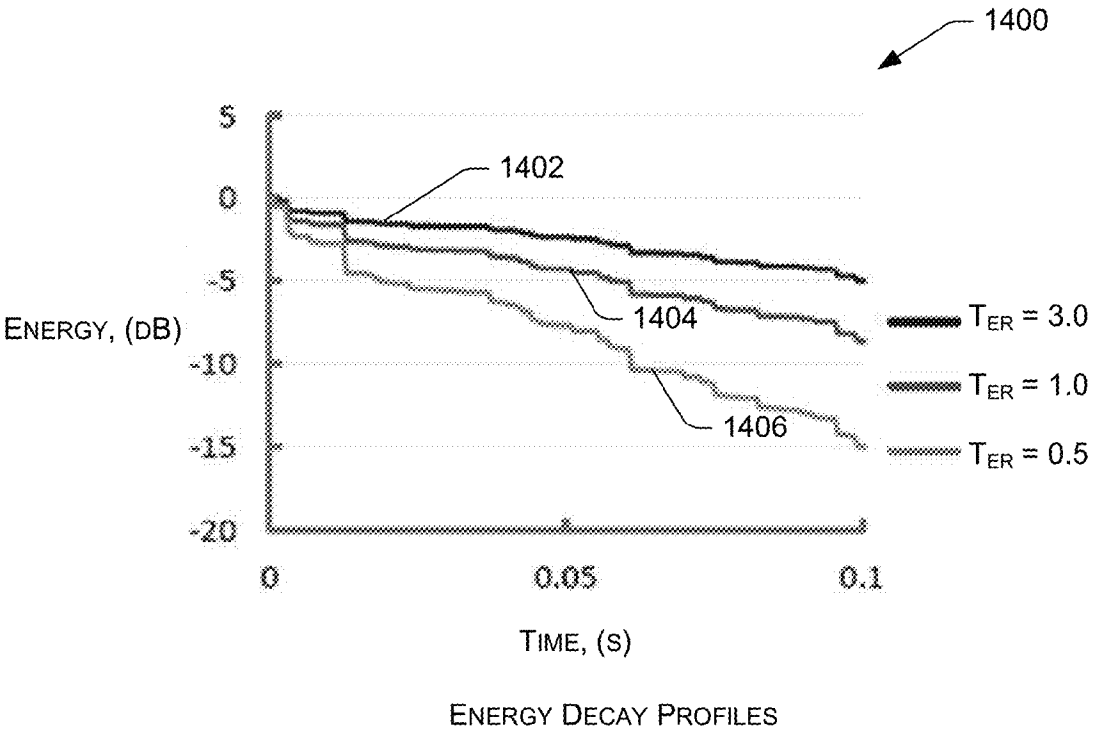
FIG. 14 is a diagram illustrating example energy decay curves for generation of canonical filters for an early reflections phase.

In at least one example, as depicted in FIG. 13, in order to render the parameters the computing resource may use global canonical filters (CFs) whose output achieves the effect of applying individual impulse responses to reproduce the properties represented by the parameter values for a run-time source-listener pair. For example, consider the $i^{th}$ run-time source that is to emit a monaural signal $s_i(t)$ (distinct from the preprocessed source signal s(t), by which the computing resource obtained $\{L_{DS}, L_{ER}, T_{ER}, T_{LR}\}$ for the source and listener location, as discussed above). In this example, the computing resource may apply a stereo (binaural) filter $h_i(t)$ which respects the parameters, producing as stereo output $o_i(t)=s_i*h_i$ where "*" denotes stereo convolution ($s_i$ may be input to both filter channels). The computing resource may break $h_i$ into three parts as $h_i=h_i^{DS}+h_i^{ER}+h_i^{LR}$, where each of the parts represents a portion of the filter that respects the parameters in a manner that correlates with the phases of the impulse response for a source/listener pair. Therefore, for example, applying an acoustic filter that respects the parameters may be expressed by a sum of three convolutions: $o_i(t)=o_i^{DS}+o_i^{ER}+o_i^{LR}=h_i^{DS}*s_i+h_i^{ER}*s_i+h_i^{LR}*s_i$ (1302, 1306, 1312, and 1314, respectively).

To properly respect the parameters for a particular source/listener impulse response and thereby properly auralize $s_i$, direct sound filter, $h_i^{DS}$ needs to scale $s_i$ by the encoded loudness parameter, $L_{DS}$ (1302) (i.e., by a factor of $10^{L_{DS}/20}$) (1302). In some examples, the computing resource removes distance attenuation during encoding; if that example was applied, the computing resource applies distance attenuation to $s_i$ to properly auralize $s_i$. The net scale factor for distance attenuation may be $10^{L_{DS}/20}/d$, where d is source-to-listener distance. The computing resource may also perform spatialization based on the source location and the listener's location and orientation (the computing resource may perform spatialization as described in this example at 1302). In the example application of video games, many game audio engines natively support spatialization which is performed with low latency, producing stereo output for the direct sound, $o_i^{DS}$. The other two filters, $h_i^{ER}$ and $h_i^{LR}$ may respect at least the other three parameters, $\{L_{ER}, T_{ER}, T_{LR}\}$ (a loudness and two slopes (dB/s)) (at 1304, 1308, and 1310 respectively), and the temporal density of $h_i^{ER}+h_i^{LR}$ may be continuous in order to auralize $s_i$ in a realistic way (accounted for at 1308). In other words, the decay of amplitude between early reflections, such as 612, and late reverberation, such as 702, is smooth—there is not a sudden drop or spike in overall amplitude in typical room impulse responses, after sufficient time has passed to cause significant sound diffusion.

Convolution is a very costly operation and performing hundreds of separate convolutions for each source's audio signal may be cost-prohibitive for real-time applications such as video games, especially in view of the fact that the processing device might be shared by other application-specific computation. In one example, instead of convolving the arbitrary audio signal for each signal source with a separate filter at run-time, the computing resource may utilize CFs to reduce run-time operations to scaling and summing signal source audio signals and convolving the scaled and summed signals with the CFs. In this example, the weights by which the signal source audio signals may be a function of one or more CFs and the parameters, the parameters in turn depending on the source and listener location. Utilizing CFs and filtering via interpolation of weights calculated as a function of the CFs avoids impulse response interpolation artifacts with a fast-moving source and/or listener.

The early reflections filter, $h_i^{ER}$, may be expressed in terms of $n_{ER}=3$ canonical filters (CFs), $H_j^{ER}$. CFs may be a number of fixed filters. In some examples, the CFs may be pre-transformed (in other words the CFs may already be transformed from the time domain to the frequency domain to avoid running costly run-time fast Fourier-transforms). In at least one example, fixed means the filters have characteristics that are not modified before the filters are convolved with a signal. In at least one example, having characteristics that are not modified means that details of the canonical filters may vary so long as the details of the canonical filters continue to conform to the characteristics (which remain unmodified). In various examples, in a video game application where a player position transitions from a city environment to a forest environment, the canonical filters may be modified to sound "forest-like" while still respecting the characteristics that are unmodified. In this way the perceptual parameters may be properly rendered while other effects (such as "forest-like" in the example above) may also be rendered. When the impulse response (or decoded parameters) is updated, prior techniques discard as-yet unprocessed output for older filters, which may clip the reverberation. Keeping past filters active until they exhaust their output, for all sound sources, is costly. Using CFs avoids this problem as arbitrary audio sources are processed with interpolation weights updated per video frame, effectively rendering it with an up-to-date, untruncated impulse response unique to the source-listener pair. In regard to the video game context, this technique integrates easily with current game audio engines, which naturally support feeding a linear combination of signals to a few fixed filters. In game audio terminology, the linear combination is performed by buses that sum their inputs. The CFs "effect" on the buses and per-source scale factors are the bus "send values."

Figure 15:
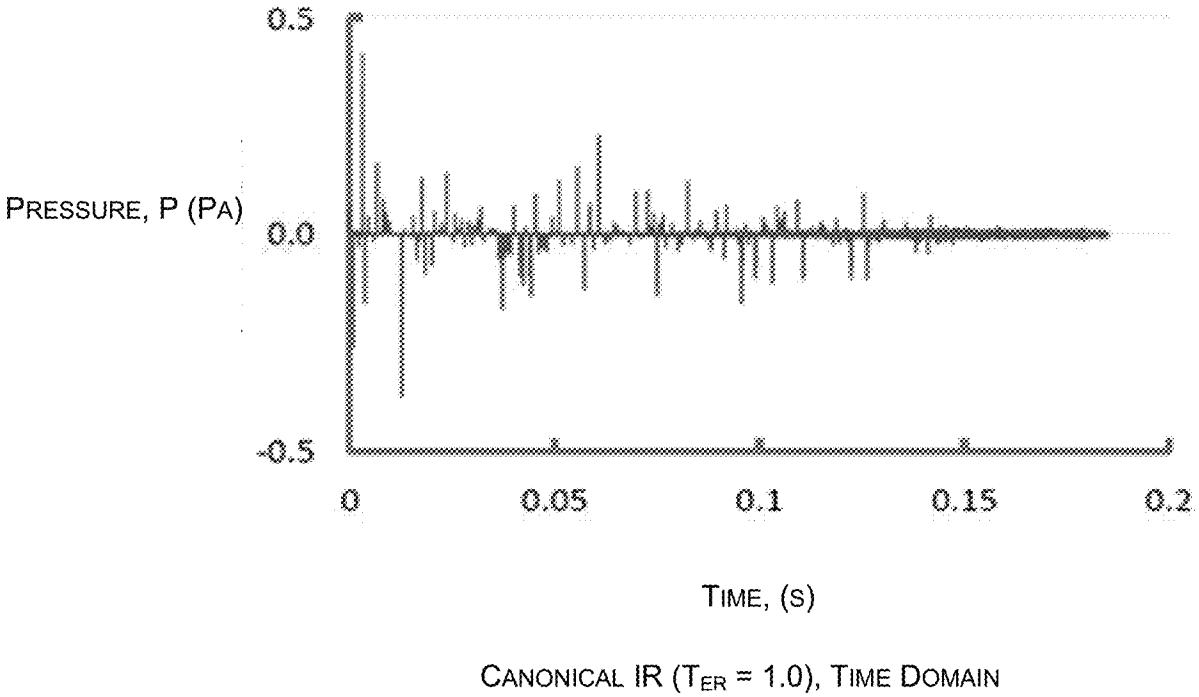
FIG. 15 is a diagram illustrating an example time domain canonical filter that satisfies an energy decay curve depicted in FIG. 14.
Figure 16:
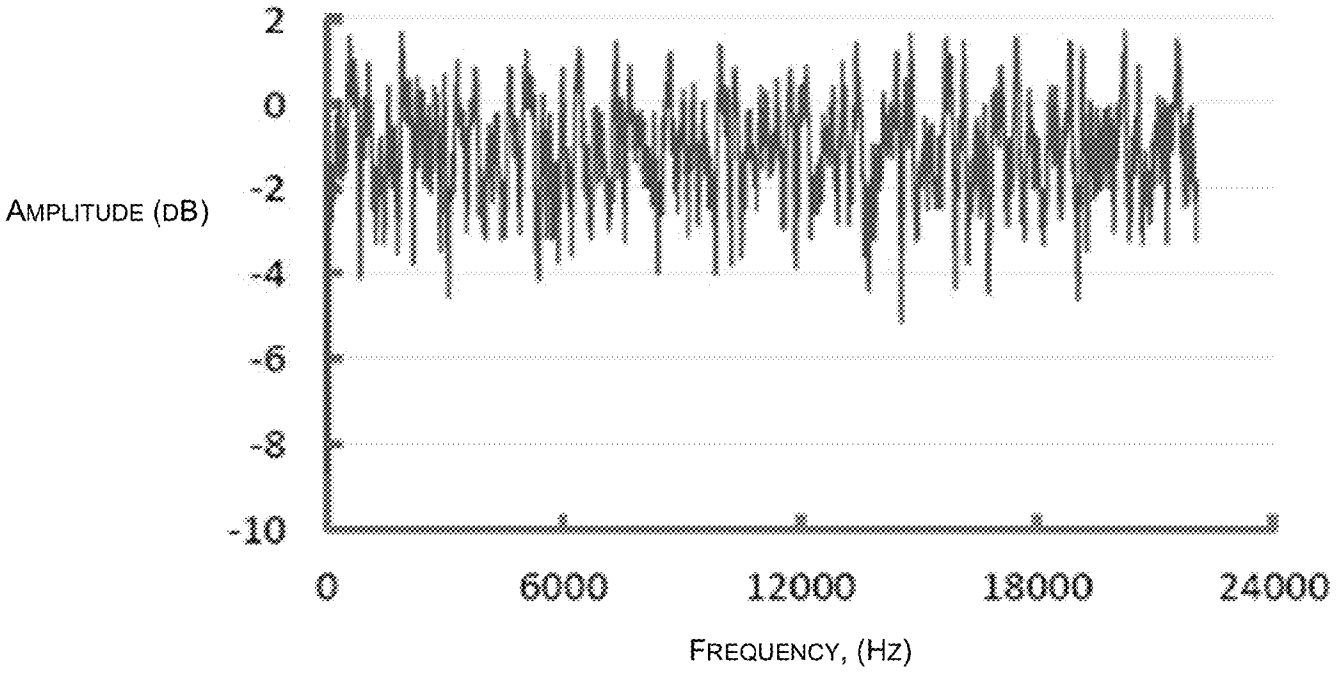
FIG. 16 is a diagram illustrating an example frequency domain canonical filter that satisfies an energy decay curve depicted in FIG. 14.

In at least one example, the set of early reflection CFs has three properties. First, the CFs may have the same time delays for their non-zero values (peaks), allowing the CFs to be linearly interpolated without peak aliasing, 1302. Second, the CFs have 0 dB (unit) loudness. Third, the CFs have exponential energy decay curves satisfying the filters' assigned decay time, denoted $T_{ER}^j$ (see 1402, 1404, and 1406 of FIG. 14). FIG. 15 depicts an example CF displayed in the time domain that has these properties and has an energy decay curve satisfying a decay time of 1.0 second. FIG. 16 depicts an example CF displayed in the frequency domain that also has these properties and illustrates a flat frequency response. Since the peak delays of the CFs may be shared, linearly interpolating two of these CFs yields a filter with intermediate energy decay and unit loudness that varies monotonically as interpolation weights vary monotonically. The computing resource may enforce $L_{ER}$ by scaling the signal as in the case of direct sound (1304). This could be done by scaling a weight applied to the signal. Alternatively, the computing resource may enforce $L_{ER}$ by scaling the filter or the convolution because of the associative property of convolution. FIG. 13 depicts just one implementation where the computing resource scales the signal (1302, 1304, and 1310).

Given $T_{ER}$, the computing resource interpolates over two CFs such that $T_{ER}^j \leq T_{ER} \leq T_{ER}^{j+1}$. For example, the CFs may have energy decay profiles, as FIG. 14 at 1400 illustrates, corresponding to early decay time values of 0.5, 1.0, and 3.0 seconds (any $T_{ER}$ outside the range 0.5-3.0 would therefore be clamped) (see example energy decay profiles 1402, 1404, and 1406). In this example, in order to achieve a $T_{ER}$ of 0.7, the computing resource would interpolate between the CFs having energy decay profiles corresponding to decay times of 0.5 and 1.0 seconds, respectively. In some examples, filter parameters may comprise energy decay profiles and other filter characteristics such as, for example, cutoff frequency, roll-off, transition bands, and ripple.

In at least one example, the computing resource may find the interpolation weights $\alpha_j^{ER}$ and $\alpha_{j+1}^{ER}$, by assuming that the decay curves are exponential, in some cases perfectly exponential, and requiring that the linearly interpolated result match the ideal exponential decay for $T_{ER}$ at a "matching time," $t_m$ (e.g., the rendering module may choose the middle of the ER: $t_m=\Delta_{ER}/2=100$ ms, which ensures that the interpolated filter's early decay time has a maximum relative error less than 5%, comparable to perceptual limens as per the ISO). The weights may be multiplied by a factor to enforce loudness via (1304)

$$\alpha_j^{ER} = 10^{-L_{ER}/20}\frac{10^{-3t_m/T_{ER}^{j+1}} - 10^{-3t_m/T_{ER}}}{10^{-3t_m/T_{ER}^{j+1}} - 10^{-3t_m/T_{ER}^{j}}}$$

$$\alpha_{j+1}^{ER} = 10^{-L_{ER}/20} - \alpha_j^{ER}.$$

In at least one example, as illustrated by the equations above, the weights may depend on both the canonical filter and the decoded parameters. The factor $10^{-3t_m/T_{ER}^{j+1}}$ evaluates at $t_m$ an exponential curve that decays by 60 dB in $T_{ER}^j$. The filter $h_i^{ER}$ may therefore be described as the linear combination $$h_i^{ER} \approx \sum_{j=1}^{n_{ER}} \alpha_j^{ER}(L_{ER}^i, T_{ER}^i)H_j^{ER}(t).$$

Note that, although one example given limited simulation and extraction of parameters from frequencies up to $\nu_{max}=500$ Hz due to practical limitations of pre-compute time, $\nu_{max}$ could be higher and, even if it is not, the CFs applied here may be wideband CFs respecting the loudness and decay time parameters. Propagation characteristics may be thus extended into unmodeled higher frequencies, producing approximate but plausible results.

Applying this equation and interchanging summations, the rendered early reflections output $o^{ER}(t)=\Sigma_i h_i^{ER} * s_i$ 1306 may be given by: $o^{ER}(t) \approx \Sigma_{j=1}^{n_{ER}}(H_j^{ER} * \Sigma_i \alpha_j^{ER}(L_{ER}^i, T_{ER}^i)s_i)$ where the term $\Sigma_i \alpha_j^{ER}(L_{ER}^i, T_{ER}^i)s_i$ is depicted at 1304. In other words, the propagated early reflections at a listener location of an arbitrary audio signal emitted at a source location may be the sum canonical filters convolved with the weighted (sum of) source(s) (1306) (note that in the implementation shown in the equation above, the signal is scaled by $L_{ER}$).

Computing the late reverberation output, $o_{LR}(t)$, may be similar (1308, 1310, and 1312). The computing resource may use $n_{ER}=3$ CFs, $H_j^{LR}$, with decay times of, for example, 0.75, 1.5, and 3.0 seconds and define the matching time as, for example, $t_m=0.75\ T_{LR}$ 1316. These example choices yield relative error less than 5.7%, again comparable to the perceptual limen for decay times. In some examples, the loudness of the late reverberation, $L_{LR}$, is not stored explicitly (necessitating 1308). Rather, it may be derived by enforcing continuity of energy density: the energy per unit time at the start of the late reverberation must match that at the end of the early reflections (1308). In that example, the computing resource may estimate energy in the 40 ms tail of the interpolated filter $h_i^{ER}$ calculated above, which determines $L_{LR}$ (1308). Denoting $E(H_j^{ER})$ as the energy integral on the last 40 ms of the $j^{th}$ CF, $E=(\Sigma_j\alpha_j\sqrt{E_j})^2$, from which $L_{LR}=10\log_{10}E$ (1308). In various examples, the loudness of the late reverberation could be stored. The computing resource may apply the same procedure described above for the early reflections phase, such as 614, to find the CF interpolation coefficients for the impulse response, $\alpha_j^{LR}$ and $\alpha_{j+1}^{LR}$ (1310 and 1312).

Once the CF interpolation coefficients have been found, thereby correctly weighting the CFs to conform to the decoded parameters characterizing the corresponding impulse response, the computing resource applies the filters to the input signal: $o_i(t)=o_i^{DS}+o_i^{ER}+o_i^{LR}+h_i^{DS}*s_is_i+h_i^{ER}*s_is_i+h_i^{LR}*s_is_i$ (1302, 1306, 1312, and 1314). The computing resource may compute the convolution using any convolution method. In at least one example, the computing resource uses partitioned frequency-domain convolution to apply CFs to the weighted sum of source signals (1314):

$$o(t)\approx\sum_i o_i^{DS}+\sum_{j=1}^{n_{ER}}\left(H_j^{ER}*\sum_i\alpha_j^{ER}(L_{ER}^i,T_{ER}^i)s_i\right)+\sum_{j=1}^{n_{LR}}\left(H_j^{LR}*\sum_i\alpha_j^{LR}(L_{LR}^i,T_{LR}^i)s_i\right)$$

Because the impulse response phases occur sequentially in time, a delay may be introduced. The amplitude of $h_{ER}$ and $h_{LR}$ may be zero for the first $\Delta_{DS}$ seconds of $h_{ER}$ and $\Delta_{DS}+\Delta_{ER}$ seconds of $h_{LR}$ to account for this time delay. Partitioned convolution trades off latency for efficiency: longer partitions are faster to compute but introduce more latency because a partition must be full before the convolution may be performed. Because the filters induce a delay when convolved, the computing resource may instead let the partition size introduce the delay, and remove the corresponding amount of delay from the impulse response. No overall delay is introduced but the convolution may be accelerated by the larger partition size. For example, a partition size of 614-1024 samples for $H_j^{ER}$ and 8192 samples for $H_j^{LR}$. At 44100 Hz, a partition size of 614-1024 samples corresponds to an initial delay of 11-22 ms in the early reflections after the direct sound, and 185 ms in the late reverberation.

Each set of CFs, $\{H_j^{ER}\}$ and $\{H_j^{LR}\}$, may satisfy three properties: each set of CFs may be "linearly-interpolatable," and each of its members may be unit energy and satisfy a specified energy decay profile. So long as a filter meets these criteria, it may be integrated into this system as a "CF". In some examples, CFs for the early reflections phase, such as 614, may be represented as the sum of diffuse and specular parts such that their sum has unit energy and matches the targeted exponential energy decay curve. For example, the specular signal may comprise sparse peaks whose sample delays may be prime numbers, which minimizes coloration artifacts from periodic delays, and the diffuse signal may comprise white noise with a quadratically increasing amplitude, normalized to constitute 10% of the signal's total energy. More specifically the diffuse signal may be initialized to $D_j=t^2G(t)$, $t\epsilon[0,\Delta_{ER}]$, where G is Gaussian white noise with zero mean and unit variance. To enforce the specified energy decay, random amplitudes may be assigned to the peaks and 10 ms bins of the peaks may be scaled to have the total energy governed by the decay rate. Since time quantization may lead to inaccuracy, a relaxation pass which computes the Schroeder integral and finds its slope may be employed. In that example, the true slope may be subtracted from the expected slope and the signal may be multiplied by an exponential corresponding to the difference, producing an energy decay curve that agrees with the required decay time. Finally, the signal may be normalized to have unit energy. In some examples, diffuse signals complying with an energy decay curve may be produced using time quantization. In some examples, the CFs share the same specular peaks and the same diffuse noise signal to aid linear interpolation, although in various examples they do not.

In at least one example, late reverberation CFs may comprise white noise with an exponential envelope determined by the respective decay rate governing the CF. A shared noise signal may be employed across the late reverberation CFs, but different signals may be generated for some or all of the filters in some examples. In at least one example, the computing resource does not account for (frequency-dependent) atmospheric attenuation. In that example, the late reverberation CFs may be modified to model atmospheric attenuation. For example, using a sample at t corresponding to a wavefront that has traveled a distance d=ct, assuming a constant speed of sound, one may use formulas from ISO 9613-1 to compute the attenuation for each frequency at any propagation distance d. A sliding window to compute short-time Fourier transforms may be applied and reshaped to appropriately account for atmospheric absorption at d. The results may be accumulated over the windows. In some examples the computing resource accounts for atmospheric attenuation.

FIG. 17 is a table depicting experimental results of an example implementation of the simulation and encoding techniques described herein conducted on five example environments termed "scenes:" "Citadel," "Deck," "Sanctuary," "Necropolis," and "Foliage". The table illustrates the raw size in terabytes of the simulated pressure field for each example environment in the "raw (TB)" column, the encoded parameter field size in megabytes in the "encoded (MB)" column, the calculation time in hours in the "bake (h)" column, and the spatial compression ratios of four example parameters in the $L_{DS}$, $L_{ER}$, $T_{ER}$, and $T_{LR}$ columns, and the net spatial compression ratios of the four example parameters in the "net" column.

Figure 18:
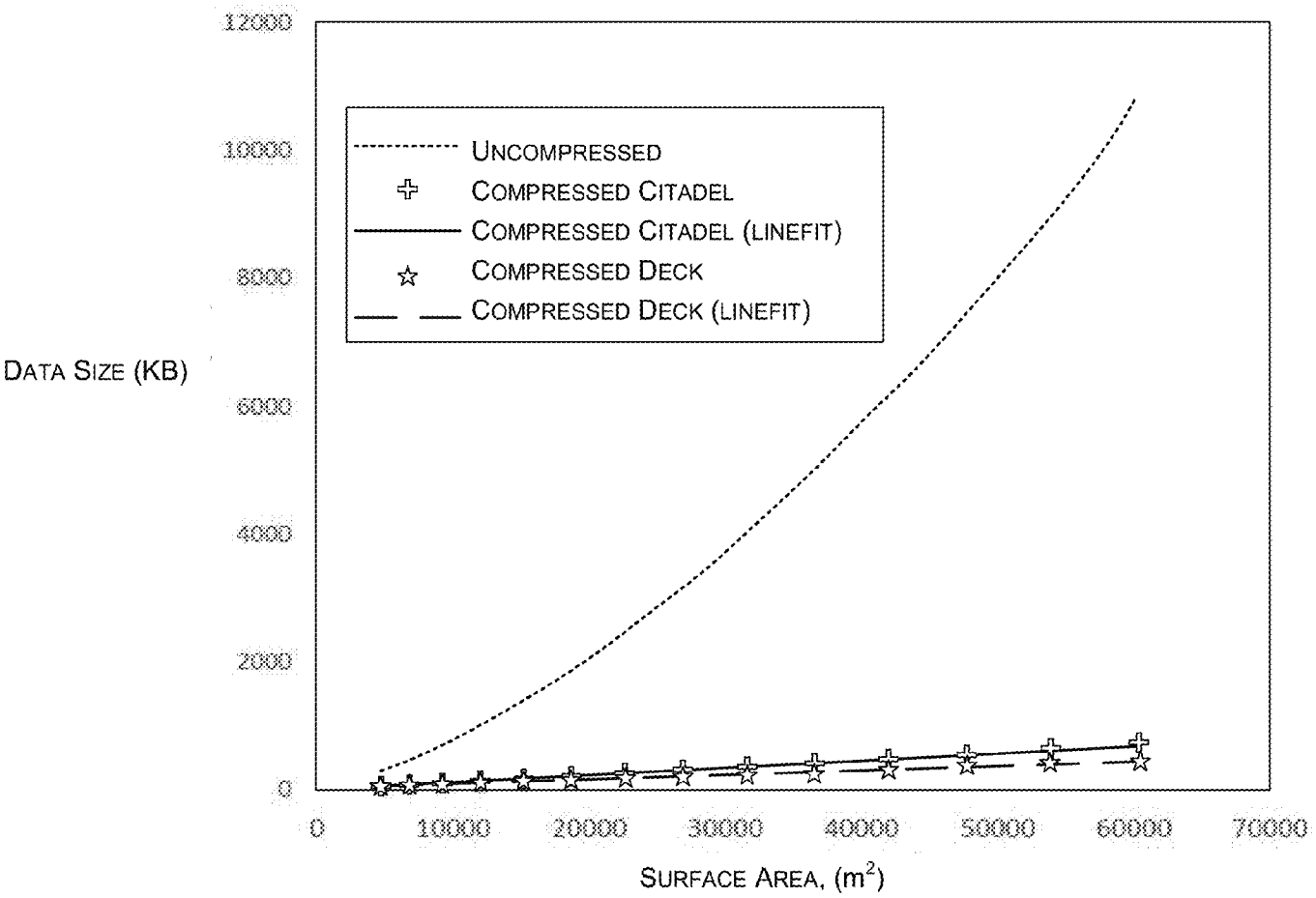
FIG. 18 is a diagram illustrating experimental results of one simulation and encoding example conducted on two virtual environments compared to an unencoded virtual environment.

FIG. 18 is a diagram illustrating experimental results of one simulation and encoding example conducted on two example virtual environments compared to an unencoded virtual environment. This diagram demonstrates that as scenes become larger, encoded parameter field size scales as a function of the scene's surface area rather than the volume of the scene. The dimensionality of the results indicates that a further dimension has been removed in addition to time, going from seven dimensions (volume×volume×time) to five dimensions (volume×area). Therefore, the encoded parameters field size scales linearly with the surface area of the bounding cylinder. The unencoded size of the impulse-response field for one of the probe sources scales with scene volume, and therefore has super-linear growth in surface area.

EXAMPLE CLAUSES

A. A method comprising: receiving parameterized impulse responses of an environment; decoding parameters from the parameterized impulse responses to obtain decoded parameters; and computing weights, a weighted linear combination of canonical filters weighted with the weights conforming to the decoded parameters.

B. The method as paragraph A recites, the decoding comprising: receiving a source position and a listener position in continuous three-dimensional space; choosing a set of probe samples from a plurality of fixed first locations based at least in part on the source position, the plurality of fixed first locations representing spatial samples of the environment; choosing a set of receiver samples from a plurality of fixed second locations based at least in part on the listener position, the plurality of fixed second locations representing spatial samples of the environment; computing perceptual parameters for the set of probe samples and the set of receiver samples from the parameterized impulse response; computing spatial weights for the set of probe samples and the set of receiver samples based at least in part on the source and listener position; and interpolating decoded parameters from the perceptual parameter based at least in part on the spatial weights.

C. The method as either paragraph A or B recites, the decoding further comprising inverting the source position and receiver position in the continuous three-dimensional space.

D. The method as either paragraph A or B recites, wherein the parameterized impulse responses comprise perceptual parameters extracted from simulated impulse responses, the perceptual parameters being a function of at least a receiver location.

E. The method as paragraph D recites, wherein the simulated impulse responses comprise a plurality of signal responses of the environment to emissions of pulses from a plurality of first locations, wherein one of the plurality of signal responses at a second location is a signal response to a pulse emitted from one of the plurality of first locations as received after modification by the environment at the second location.

F. The method as either paragraph D or E recites, the perceptual parameters including: a first parameter corresponding to direct sound loudness; a second parameter corresponding to early reflection loudness; a third parameter corresponding to early decay time; and a fourth parameter corresponding to late reverberation time.

G. The method as any one of paragraphs A, B, or D recites, the parameterized impulse responses further being at least one or more of: spatially smoothed; spatially sampled; quantized; spatially compressed; or stored.

H. The method as any one of paragraphs A, B, D, or G recites, further comprising: receiving an audio signal; copying the audio signal to obtain signal copies; and scaling the signal copies based at least in part on the weights to obtain a scaled signal copy.

I. The method as paragraph H recites, wherein the audio signal is one of a plurality of audio signals and the copying and scaling as paragraph H recites is performed for respective others of the plurality of signals to receive scaled signal copies, the plurality of signals corresponding to source locations.

J. The method as paragraph I recites, further comprising applying canonical filters to the scaled signal copies, the applying comprising summing the scaled copies; and providing the sum of scaled copies as an input to at least one of the canonical filters.

K. The method as either paragraph I or paragraph J recites, further comprising: convolving the sum of scaled copies with individual of, respective of, or each of the canonical filters to obtain filtered audio signals; and summing the filtered audio signals to obtain a propagated audio signal.

L. The method as any one of paragraphs A, J, or K recites, wherein the canonical filters conform to corresponding filter parameters and satisfy the following properties: a filter obtained by interpolating any two canonical filters of the canonical filters conforms to intermediate filter parameters between the two canonical filters; and the intermediate parameters change monotonically when an interpolation weight is changed monotonically.

M. The method as any one of paragraphs A or J-L recites, wherein the canonical filters include at least one filter transformed into frequency domain and having fixed characteristics.

N. A device comprising: one or more processing units; computer-readable media with modules stored thereon, the modules comprising: an encoding module configured to parameterize an impulse response field of an environment to obtain a parameterized impulse response field; a decoding module configured to: receive a signal transmission location and a signal receiver location; and decode parameters from the parameterized impulse response field to obtain decoded parameters, the decoding based in part on the signal transmission location and the signal receiver location and the decoded parameters corresponding to perceptual features of an impulse response of the environment at the signal receiver location; and a rendering module configured to apply filters to a signal to be propagated from the signal transmission location to the signal receiver location, the applying based at least in part on the decoded parameters.

O. The device as paragraph N recites, wherein amplitudes of the impulse response field vary based at least in part on at least one of pulse transmission location, reception location, or time.

P. The device as paragraph N recites, the rendering module further configured to: calculate weights based at least in part on the decoded parameters; scale the signal based at least in part on the weights to obtain a scaled signal; and convolve the scaled signal with the filters.

Q. The device as paragraph P recites, wherein a sum of the filters scaled by the weights conforms to the decoded parameters.

R. The device as any one of paragraphs N-Q recites, the rendering module further configured to: calculate weights based at least in part on the decoded parameters; scale the filters based at least in part on the weights to obtain scaled filters; and convolve the scaled filters with the signal.

S. One or more computer-readable media storing computer-executable instructions that, when executed on one or more processors, configure a computer to perform acts comprising: simulating a first time-varying pressure field in an environment, the first time-varying pressure field based at least in part on a pulse emitted from a first location in the environment; simulating a second time-varying pressure field in the environment, the second time-varying pressure field based at least in part on a pulse emitted from a second location in the environment; and encoding the first time-varying pressure field and the second time-varying pressure field to obtain encoded parameter fields, the encoding comprising: extracting first parameter fields from the first time-varying pressure field; and extracting second parameter fields from the first time-varying pressure field.

T. The computer-readable media as paragraph S recites, wherein the acts further comprise: receiving a signal and a third location, the third location representing the location of a receiver in the environment; decoding the encoded parameter fields at locations in the encoded parameter fields corresponding to the third location to receive decoded parameters; calculating weights based at least in part on the decoded parameters, the weights conforming to the decoded parameters; weighting the signal to receive a weighted signal applying canonical filters to the weighted signal to receive a propagated signal, the and playing the propagated signal.

U. The computer-readable media as either paragraph S or T recites, wherein the acts further comprise: concatenating the second parameter fields to the first parameter fields to obtain concatenated parameter fields; and compressing the concatenated parameter fields as encoded parameter fields to obtain encoded parameter fields;

V. The computer-readable media as any one of paragraphs S-U recites, wherein time-implicitness of the parameters removes at least one dimension from the first time-varying pressure field and the second time-varying pressure field.

W. A method for auralization comprising: receiving a multiplicity of pairs, the pairs comprising audio signals and acoustic parameters corresponding to respective audio signals; and auralizing the acoustic parameters for the audio signals by applying a weighted linear combination of a set of canonical filters to the audio signals, the canonical filters comprising fixed filters and the receiving and the auralizing conducted such that the fixed filters do not increase in number as the audio signals increase in number.

CONCLUSION

Although the subject matter has been described in language specific to structural features and/or methodological acts, it is to be understood that the subject matter defined in the appended claims is not necessarily limited to the specific features or acts described. Rather, the specific features and steps are disclosed as example forms of implementing the claims.

All of the methods and processes described above may be embodied in, and fully automated via, software code modules executed by one or more general purpose computers or processors. The code modules may be stored in any type of computer-readable storage medium or other computer storage device. Some or all of the methods may alternatively be embodied in specialized computer hardware.

Conditional language such as, among others, "can," "could," "may" or "may," unless specifically stated otherwise, are understood within the context to present that certain examples include, while other examples do not include, certain features, elements and/or steps. Thus, such conditional language is not generally intended to imply that certain features, elements and/or steps are in any way required for one or more examples or that one or more examples necessarily include logic for deciding, with or without user input or prompting, whether certain features, elements and/or steps are included or are to be performed in any particular example.

Conjunctive language such as the phrase "at least one of X, Y or Z," unless specifically stated otherwise, is to be understood to present that an item, term, etc. may be either X, Y, or Z, or a combination thereof.

Any routine descriptions, elements or blocks in the flow diagrams described herein and/or depicted in the attached figures should be understood as potentially representing modules, segments, or portions of code that include one or more executable instructions for implementing specific logical functions or elements in the routine. Alternate implementations are included within the scope of the examples described herein in which elements or functions may be deleted, or executed out of order from that shown or discussed, including substantially synchronously or in reverse order, depending on the functionality involved as would be understood by those skilled in the art.

It should be emphasized that many variations and modifications may be made to the above-described examples, the elements of which are to be understood as being among other acceptable examples. All such modifications and variations are intended to be included herein within the scope of this disclosure and protected by the following claims.

What is claimed is:

1. A method comprising:

receiving parameterized impulse responses of an environment;

decoding parameters from the parameterized impulse responses to obtain decoded parameters; and computing weights, a weighted linear combination of canonical filters weighted with the weights conforming to the decoded parameters.

2. The method of claim 1, the decoding comprising:

receiving a source position and a listener position in continuous three-dimensional space;

choosing a set of probe samples from a plurality of fixed first locations based at least in part on the source position, the plurality of fixed first locations representing spatial samples of the environment;

choosing a set of receiver samples from a plurality of fixed second locations based at least in part on the listener position, the plurality of fixed second locations representing spatial samples of the environment;

computing perceptual parameters for the set of probe samples and the set of receiver samples from the parameterized impulse response;

computing spatial weights for the set of probe samples and the set of receiver samples based at least in part on the source and listener position; and interpolating decoded parameters from the perceptual parameter based at least in part on the spatial weights.

3. The method of claim 2, the decoding further comprising inverting the source position and receiver position in the continuous three-dimensional space.

4. The method of claim 1, wherein the parameterized impulse responses comprise perceptual parameters extracted from simulated impulse responses, the perceptual parameters being a function of at least a receiver location.

5. The method of claim 4, wherein the simulated impulse responses comprise a plurality of signal responses of the environment to emissions of pulses from a plurality of first locations, wherein one of the plurality of signal responses at a second location is a signal response to a pulse emitted from one of the plurality of first locations as received after modification by the environment at the second location.

6. The method of claim 4, the perceptual parameters including:

a first parameter corresponding to direct sound loudness;

a second parameter corresponding to early reflection loudness;

a third parameter corresponding to early decay time; and a fourth parameter corresponding to late reverberation time.

7. The method of claim 4, the parameterized impulse responses further being at least one or more of:

spatially smoothed;

spatially sampled;

quantized;

spatially compressed; or stored.

8. The method of claim 1, further comprising:

receiving an audio signal;

copying the audio signal to obtain signal copies; and scaling the signal copies based at least in part on the weights to obtain a scaled signal copy.

9. The method of claim 8, wherein the canonical filters include at least one filter transformed into frequency domain and having fixed characteristics.

10. The method of claim 8, wherein the audio signal is one of a plurality of audio signals and the copying and scaling of claim 8 is performed for respective others of the plurality of signals to receive scaled signal copies, the plurality of signals corresponding to source locations.

11. The method of claim 10, further comprising applying canonical filters to the scaled signal copies , the applying comprising:

summing the scaled copies; and providing the sum of scaled copies as an input to at least one of the canonical filters.

12. The method of claim 11 further comprising:

convolving the sum of scaled copies with each of the canonical filters to obtain filtered audio signals; and summing the filtered audio signals to obtain a propagated audio signal.

13. The method of claim 1, wherein the canonical filters conform to corresponding filter parameters and satisfy the following properties:

a filter obtained by interpolating any two canonical filters of the canonical filters conforms to intermediate filter parameters between the two canonical filters; and the intermediate parameters change monotonically when an interpolation weight is changed monotonically.

14. A device comprising:

one or more processing units;

computer-readable media with modules stored thereon, the modules comprising:

an encoding module configured to parameterize an impulse response field of an environment to obtain a parameterized impulse response field;

a decoding module configured to:

receive a signal transmission location and a signal receiver location; and decode parameters from the parameterized impulse response field to obtain decoded parameters, the decoding based in part on the signal transmission location and the signal receiver location and the decoded parameters corresponding to perceptual features of an impulse response of the environment at the signal receiver location; and a rendering module configured to apply filters to a signal to be propagated from the signal transmission location to the signal receiver location, the applying based at least in part on calculating weights based at least in part on the decoded parameters and scaling the signal based at least in part on the weights to obtain a scaled signal.

15. The device of claim 14, wherein amplitudes of the impulse response field vary based at least in part on at least one of pulse transmission location, reception location, or time.

16. The device of claim 14, the rendering module further configured to convolve the scaled signal with the filters.

17. The device of claim 14, wherein a sum of the filters scaled by the weights conforms to the decoded parameters.

18. One or more computer storage media storing computer-executable instructions that, when executed on one or more processors, configure a computer to perform acts comprising:

simulating a first time-varying pressure field in an environment, the first time-varying pressure field based at least in part on a pulse emitted from a first location in the environment;

simulating a second time-varying pressure field in the environment, the second time-varying pressure field based at least in part on a pulse emitted from a second location in the environment; and encoding the first time-varying pressure field and the second time-varying pressure field to obtain encoded perceptual parameter fields, the encoding comprising:

extracting first perceptual parameter fields from the first time-varying pressure field; and extracting second perceptual parameter fields from the first time-varying pressure field.

19. The computer storage media of claim 18, wherein the acts further comprise:

receiving a signal and a third location, the third location representing the location of a receiver in the environment;

decoding the encoded perceptual parameter fields at locations in the encoded parameter fields corresponding to the third location to receive decoded perceptual parameters;

calculating weights based at least in part on the decoded perceptual parameters, the weights conforming to the decoded perceptual parameters;

weighting the signal to receive a weighted signal;

applying canonical filters to the weighted signal to receive a propagated signal, the and playing the propagated signal.

20. The computer storage media of claim 18, wherein the acts further comprise:

concatenating the second perceptual parameter fields to the first perceptual parameter fields to obtain concatenated parameter fields; and compressing the concatenated perceptual parameter fields as encoded parameter fields to obtain encoded parameter fields.

21. A method for auralization comprising:

receiving a multiplicity of pairs, the pairs comprising audio signals and acoustic parameters corresponding to respective audio signals; and auralizing the acoustic parameters for the audio signals by applying a weighted linear combination of a set of canonical filters to the audio signals, the canonical filters comprising fixed filters and the receiving and the auralizing conducted such that the fixed filters do not increase in number as the audio signals increase in number.

* * * * *